US012644270B2

(12) United States Patent
Miller et al.

(10) Patent No.: US 12,644,270 B2
(45) Date of Patent: Jun. 2, 2026

(54) STORMWATER MANAGEMENT CRATE ASSEMBLY WITH TAPERED COLUMNS

(71) Applicant: ADVANCED DRAINAGE SYSTEMS, INC, Hilliard, OH (US)

(72) Inventors: Adam Miller, Haddam, CT (US); Dan Swistak, Newmarket, NH (US); Bryan Coppes, Old Saybrook, CT (US); Ronald Vitarelli, Marlborough, CT (US); Paul Holbrook, Old Saybrook, CT (US)

(73) Assignee: Advanced Drainage Systems, Inc., Hilliard, OH (US)

( * ) Notice: Subject to any disclaimer, the term of this patent is extended or adjusted under 35 U.S.C. 154(b) by 234 days.

(21) Appl. No.: 18/162,322

(22) Filed: Jan. 31, 2023

(65) Prior Publication Data

US 2023/0243143 A1 Aug. 3, 2023

Related U.S. Application Data

(63) Continuation-in-part of application No. 17/938,600, filed on Oct. 6, 2022.

(Continued)

(51) Int. Cl.
*E03F 1/00* (2006.01)
*E03F 5/10* (2006.01)

(52) U.S. Cl.
CPC ..... *E03F 1/005* (2013.01); *E03F 5/10* (2013.01)

(58) Field of Classification Search
CPC .. E03F 1/005; E03F 5/14; E02B 11/00; E02B 11/005
See application file for complete search history.

(56) References Cited

U.S. PATENT DOCUMENTS 8,162,567 B2 * 4/2012 Obermeyer ..... E03F 1/002 405/53
11,492,793 B2 * 11/2022 Kulick, III ..... E03F 1/002

(Continued)

FOREIGN PATENT DOCUMENTS

AU 2020404765 7/2022
CN 110382796 10/2019

(Continued)

OTHER PUBLICATIONS

International Search Report and Written Opinion from PCT/US2024/013732, May 8, 2024; 10 pages.

(Continued)

*Primary Examiner* — Benjamin F Fiorello
(74) *Attorney, Agent, or Firm* — FINNEGAN, HENDERSON, FARABOW, GARRETT & DUNNER L.L.P

(57) ABSTRACT

Stormwater management systems, methods, and apparatus for containing and filtering runoff may be provided. In one implementation, a stormwater management crate for managing stormwater runoff may be provided. The stormwater management crate may include a top plate having a first plurality of support column attachments and one or more support column assemblies located below the top plate; the one or more support column assemblies being affixed to the top plate at the support column attachments. The stormwater management crate may further include an intermediate plate may be located below the top plate and above the bottom plate. The intermediate plate may have a third plurality of support column attachments. The intermediate plate may be lightweight and may weigh less than one or both of the top plate and the bottom plate.

19 Claims, 34 Drawing Sheets

Related U.S. Application Data

(60) Provisional application No. 63/327,695, filed on Apr. 5, 2022, provisional application No. 63/262,230, filed on Oct. 7, 2021, provisional application No. 63/262,228, filed on Oct. 7, 2021.

(56) References Cited

U.S. PATENT DOCUMENTS

| | | | | |
|---|---|---|---|---|
| 2012/0255624 | A1* | 10/2012 | Canney | E02B 11/005 137/315.01 |
| 2014/0291221 | A1* | 10/2014 | Adams | E03F 3/046 210/170.03 |
| 2015/0016874 | A1* | 1/2015 | Wandkowski | F16B 5/0004 403/292 |
| 2016/0265209 | A1* | 9/2016 | Graf | E03F 1/005 |
| 2016/0295812 | A1* | 10/2016 | Ray | E01C 9/005 |
| 2020/0032500 | A1* | 1/2020 | Bhatia | E03F 1/005 |
| 2020/0056361 | A1* | 2/2020 | Bhatia | E02B 11/005 |
| 2020/0248442 | A1* | 8/2020 | Yuki | E03F 1/005 |

FOREIGN PATENT DOCUMENTS

| | | |
|---|---|---|
| DE | 202016107113 | 3/2018 |
| EP | 3194675 | 2/2019 |
| WO | WO 2021/255588 | 12/2021 |

OTHER PUBLICATIONS

International Search Report and Written Opinion from PCT/US2024/013749, Jun. 11, 2024; 13 pages.

* cited by examiner

STORMWATER MANAGEMENT CRATE ASSEMBLY WITH TAPERED COLUMNS

CROSS-REFERENCES TO RELATED APPLICATIONS

This application is a continuation-in-part of and claims the benefit of priority of U.S. patent application Ser. No. 17,938,600, filed on Oct. 6, 2022, which claims the benefit of priority of U.S. Provisional Patent Application No. 63/262,228, filed on Oct. 7, 2021; U.S. Provisional Patent Application No. 63/262,230, filed on Oct. 7, 2021; and U.S. Provisional Patent Application No. 63/327,695, filed on Apr. 5, 2022. The contents of the foregoing applications are incorporated herein by reference in their entireties.

TECHNICAL FIELD

This disclosure relates generally to systems, apparatus, and methods for fluid runoff management. In particular, this disclosure relates to stormwater storage and retention of stormwater through use of a stormwater management crate, or through the use of a plurality of stormwater management crates formed into a stormwater management crate assembly.

BACKGROUND

Fluid runoff systems include systems designed to process rainwater or other fluid runoff, particularly stormwater. These systems can be used to control water in areas that may experience overloads in the local drainage system during periods of, high precipitation, such as around construction sites and developed urban areas. These systems temporarily store and divert water runoff from impervious surfaces, such as sidewalks, roads, and parking lots. The system then controls the fluid discharge back to the environment to meter rainfall discharge from a site and reduce the risk of flooding. Stormwater also carries debris and solid contaminants, such as dirt, sand, and organic debris. Fluid management systems are designed to receive and retain stormwater, allowing particulates to settle at the bottom of the chamber before the stormwater is released out of the system. Fluid management systems may include above-ground storage systems such as ponds, swales, or holding tanks. Fluid management systems may also include below-ground systems such as underground storage chambers, concrete drainage structures, thermoplastic storage chambers, or crate-type water management systems.

Crate-type water management systems may be used to form a chamber suitable for managing stormwater runoff. For example, multiple stormwater management crates may be connected together into a modular array of stormwater management crates, forming a stormwater management crate assembly. Stormwater management crate assemblies may be placed underground, typically underneath parking lots or green spaces. These assemblies may be wrapped in a membrane to prohibit infiltration of surrounding soil or other aggregates into the stormwater management crate assembly, forming a void space within the assembly for the storage of stormwater runoff. These underground assemblies accommodate a site's water volume runoff and treatment requirements and also maximize the site's buildable area for other beneficial uses.

During a storm, stormwater or rainwater runoff enters the underground stormwater management crate assembly, and in some configurations, may exit the assembly by flowing through a conduit connecting the assembly to another system component, such as a basin or another drainage structure. The stormwater management crate assembly may be placed on a prepared bed of coarse aggregate or stone, and may be backfilled underground with aggregate, earth, or other suitable backfill material.

Stormwater carries debris and solid contaminants that can pass into and through basins, traps, and filters of conventional stormwater management systems. Stormwater may include suspended solids, including dirt, sand, organic debris such as leaves, paper, and plastic. Crate-type water management systems may be configured to receive stormwater and allow debris to settle to a bottom of the assembly before the stormwater is released into the ground or through an outlet or may be used to restrict the volume or discharge rate of stormwater runoff from leaving the site.

Existing crate-type water management systems require intensive labor to assemble on a project site. Many of the components used to form the stormwater management crates are cumbersome and heavy to manipulate into place. Construction and assembly of the water management crates can be difficult when crate assembly components such as the plates and the columns are loosely connected during initial assembly. Separable connections may accidently disconnect, destabilizing the structural integrity of the stormwater management crate. Other problems include rigid connections between crate assembly plates and columns that do not allow flexing or rotation of the columns, which may place critical stress on the columns during assembly or after installation of the stormwater management crates, leading to damage to the columns.

Thus, solutions are needed to improve these and other deficiencies in crate-type water management systems. Such solutions should reduce labor and assembly costs by reducing the weight of the stormwater management crate plate component through structural design improvements to reduce weight and allow for easier field assembly of the crate assembly. Solutions should include lighter crates or plates that are easier to handle and assemble, without affecting the strength of the crate assembly. Other improvements should include increasing strength and durability of the crate components while maximizing the void space in the assembly suitable for storing stormwater. Solutions should also include improved connections between support columns and plates so as to permanently affix the plates and the columns during assembly, while also providing for rotation of the columns to mitigate damaging stress forces on the columns during assembly or after installation. Further solutions should allow for some components of the modular crate assemblies to be pre-assembled prior to arrival at a project site and configured for ease of final assembly upon arrival to the site to streamline and improve the construction process.

Existing crate-type solutions may suffer additional problems when fabricated solely from one type of material. For example, some crate products may be formed entirely from a filled plastic polymer, such as glass-filled polypropylene. Though columns in stormwater crates formed from glass-filled polypropylene may be strong, the stormwater crate assembly may be brittle. Alternatively, other products formed from an unfilled polymer, such as virgin polypropylene, may be less brittle than other products but may result in relatively weak columns.

Further solutions to problems in the art of stormwater management crates should include forming stormwater management crates with component parts formed from dissimilar materials, for example, by forming plate components with relatively flexible virgin materials and by forming columns with stronger reinforced materials. Solutions may include securing stormwater management crate plates to crate columns through dual-mode, insert-molding techniques and these solutions may provide appropriate structural components to secure column plates and columns formed in this way. Solutions should further consider and address variable shrinkage rates encountered when forming component parts fabricated of dissimilar materials in the molding processes.

SUMMARY

The disclosed embodiments describe systems, methods, and devices for managing fluid runoff. These systems, methods, and devices may include use of a stormwater management crate, or the use of a plurality of stormwater management crates formed into a stormwater management crate assembly. For example, in an embodiment, a stormwater management crate may include a top plate having a first plurality of support column attachments, and a plurality of support column assemblies located below the top plate. The support column assemblies may be affixed to the top plate at the support column attachments. The stormwater management crate may further include a bottom plate having a second plurality of support column attachments located below the support column assemblies, and at least one intermediate plate having a third plurality of support column attachments. The at least one intermediate plate is located below the top plate and above the bottom plate.

In some embodiments, the support column assemblies may be affixed to the at least one intermediate plate at the support column attachments. The intermediate plate may have a weight, the top plate may have a weight, and the bottom plate may have a weight, wherein the weight of the intermediate plate may be less than the weight of one or both of the top plate and the bottom plate. In some embodiments, the weight of the top plate may be substantially the same as or identical to the weight of the bottom plate.

In some embodiments, the support column assemblies may have a tapered shape. The first and second plurality of support column attachments may comprise a bayonet connection. The top plate may be configured to bear a load greater than a maximum load the intermediate plate is configured to bear.

In some embodiments, a stormwater management crate may include a top plate having a first plurality of support column attachments, a plurality of support column assemblies located below the top plate, the support column assemblies being affixed to the top plate at the support column attachments, and a lightweight intermediate plate having a second plurality of support column attachments located below the support column assemblies. The lightweight intermediate plate may weigh less than the top plate.

In some embodiments, the lightweight intermediate plate may comprise less material than the top plate. The lightweight intermediate plate may include hook locks and slot locks. The lightweight intermediate plate may be affixed to an adjacent lightweight intermediate plate. The lightweight intermediate plate may include perforations, support members, or column connection recesses.

In some embodiments, a stormwater management crate assembly may include a plurality of stormwater management crates arranged in a modular array. The stormwater management crates may comprise a top plate having a first plurality of support column attachments, a plurality of support column assemblies located below the top plate; the support column assemblies being affixed to the top plate at the support column attachments; a bottom plate having a second plurality of support column attachments located below the support column assemblies; and at least one intermediate plate having a third plurality of support column attachments; the at least one intermediate plate being located below the top plate and above the bottom plate.

In some embodiments, the at least one intermediate plate may weigh less than one or both of the top plate and the bottom plate. A first stormwater management crate may be stacked vertically on top of a second stormwater management crate. Each of the first plurality of support column assemblies and the second plurality of support column assemblies may have a tapered shape. Each of the first plurality of support column attachments and the second plurality of support column attachments may comprise a bayonet connection.

In some embodiments, one or more of the plurality of support column assemblies may include an upper portion and a lower portion. The lower portion may be affixed to the bottom plate. The support column upper portion may be affixed to a corresponding lower portion with a snap connection.

In some embodiments, the upper portion of the support column assembly may include a first set of snap connection hooks and a first set of snap connection slots and the lower portion may include a second set of snap connection hooks and a second set of snap connection slots. The first set of snap connection hooks may be configured to connect to the second set of snap connection slots, and the first set of snap connection slots may be configured to connect to the second set of snap connection hooks.

In some embodiments, the support column assemblies have a tapered shape. For example, the support column assemblies may be tapered so that the wide end of the support column assemblies is positioned against the top or bottom plate, and the narrow end of the support column assembly may be located in the middle of the column assembly, for example, at a snap connection between the upper portion and lower portion of the support column assembly.

In some embodiments, the support column attachments located on the top plate or bottom plate may comprise a bayonet connection. The support column assemblies may include a column pin integrated toward one end of the support column assembly. The column pin may be configured to interface with the support column attachment to affix the support column assembly to the top plate. In another embodiment, the bayonet connection may include a detent configured to receive the column pin. The detent may be configured to permit the support column assembly to rotate in a clockwise or counterclockwise direction from the center detent position. In another embodiment, the bayonet connection further comprises a rib configured to prevent the pin from exiting the support column attachment.

In an embodiment, the top plate may include one or more stabilization pins on the upper side of the top plate. Stabilization pins may be configured to prevent vertically stacked stormwater management crates from sliding relative to each other.

In an embodiment, the top plate may include one or more column connection recess covers.

In an embodiment, a stormwater management crate assembly may be formed by arranging one or more stormwater management crates into a module array. The stormwater management crates may include a top plate having a plurality of support column attachments and a plurality of support column assemblies located below the top plate. The support column assemblies may be affixed to the top plate at the support column attachments. The stormwater management crates may include a bottom plate having a second plurality of support column attachments located below the support column assemblies. The stormwater management crate assembly may include one or more side panels contacting at least a portion of the stormwater management crates. In an embodiment, the support column attachments of the top plates and bottom plates comprise a bayonet connection.

In an embodiment, the stormwater management crate assembly may include a membrane wrapped around the one or more stormwater management crates. In another embodiment, one of the stormwater management crates is affixed to an adjacent stormwater management crate through a hook and slot connection.

In an embodiment, a first stormwater management crate may be stacked vertically on top of a second stormwater management crate within the stormwater management crate assembly. The first and second stormwater management crates may include stabilization pins between the first and second stormwater management crates.

In an embodiment, one or more of the stormwater management crates within the stormwater management crate assembly may include a column connection recess cover on the top side of the top plate.

In an embodiment, one or more of the support column assemblies in the one or more stormwater management crates within the stormwater management crate assembly may include an upper portion and a lower portion which may or may not be identical. The lower portion may be affixed to the bottom plate of the stormwater management crate. In another embodiment, the support column upper portion may be affixed to a corresponding support column lower portion with a snap connection.

In an embodiment, a stormwater management crate may include a top plate having a first plurality of support column attachments and a plurality of support column assemblies located below the top plate. The support column assemblies may be molded to the top plate at the support column attachments. The stormwater management crate may further include a bottom plate having a second plurality of support column attachments located below the support column assemblies. The support column assemblies may include an upper portion and a lower portion. The lower portion may be affixed to the bottom plate. In some embodiments, the lower portion may be molded to the bottom plate. The support column assembly upper portion may be affixed to a corresponding lower portion with a snap connection.

In an embodiment, the support column attachment may include a circular ring circumscribing an aperture in the horizontal plane of the top plate. The support column attachment may further include a plurality of stiffening ribs. The support column attachment may also further include a recessed circular column rest located concentrically within the circular ring.

In an embodiment, the support column attachments may further include one or more tab prongs located between the circular ring and the recessed circular column rest and the support column assemblies may include one or more tab slots located towards one end of the support column assembly. The support column assemblies may be molded to the top plate by molding the support column attachment tab prongs inside the tab slots.

In an alternative embodiment, the support column attachments may include one or more tab slots located between the circular ring and the recessed circular column rest. The support column assemblies may include one or more tab prongs located towards one end of the support column assembly. The support column assemblies may be molded to the top plate by molding the column assembly tab prongs inside the tab slots.

In an embodiment, the top plate or bottom plate and the support column assemblies are formed of dissimilar materials. For example, the top plate and bottom plate may be formed from virgin polypropylene and the support column assemblies may be formed from glass-filled polypropylene.

In an embodiment, there may be a partial stormwater management crate with a single plate. Such partial stormwater management crates may be arranged for shipping and may later be assembled into complete stormwater management crates. Partial stormwater management crates may include a plate having a plurality of support column attachments and may further include a plurality of support columns affixed to the plate at the support column attachments. In an embodiment, the plurality of support columns may be affixed to the plate at the support column attachments through molding. In other embodiments, the partial stormwater management crates may be configured to include the snap style connections or bayonet style connections described herein.

Additional features and advantages of the disclosed embodiments will be set forth in part in the description that follows, and in part will be obvious from the description, or may be learned by practice of the disclosed embodiments. The features and advantages of the disclosed embodiments will be realized and attained by the elements and combinations particularly pointed out in the appended claims.

It is to be understood that both the foregoing general description and the following detailed description are examples and explanatory only and are not restrictive of the disclosed embodiments as claimed.

The accompanying drawings constitute a part of this specification. The drawings illustrate several embodiments of the present disclosure and, together with the description, serve to explain the principles of the disclosed embodiments as set forth in the accompanying claims.

DETAILED DESCRIPTION

Figure 1A:
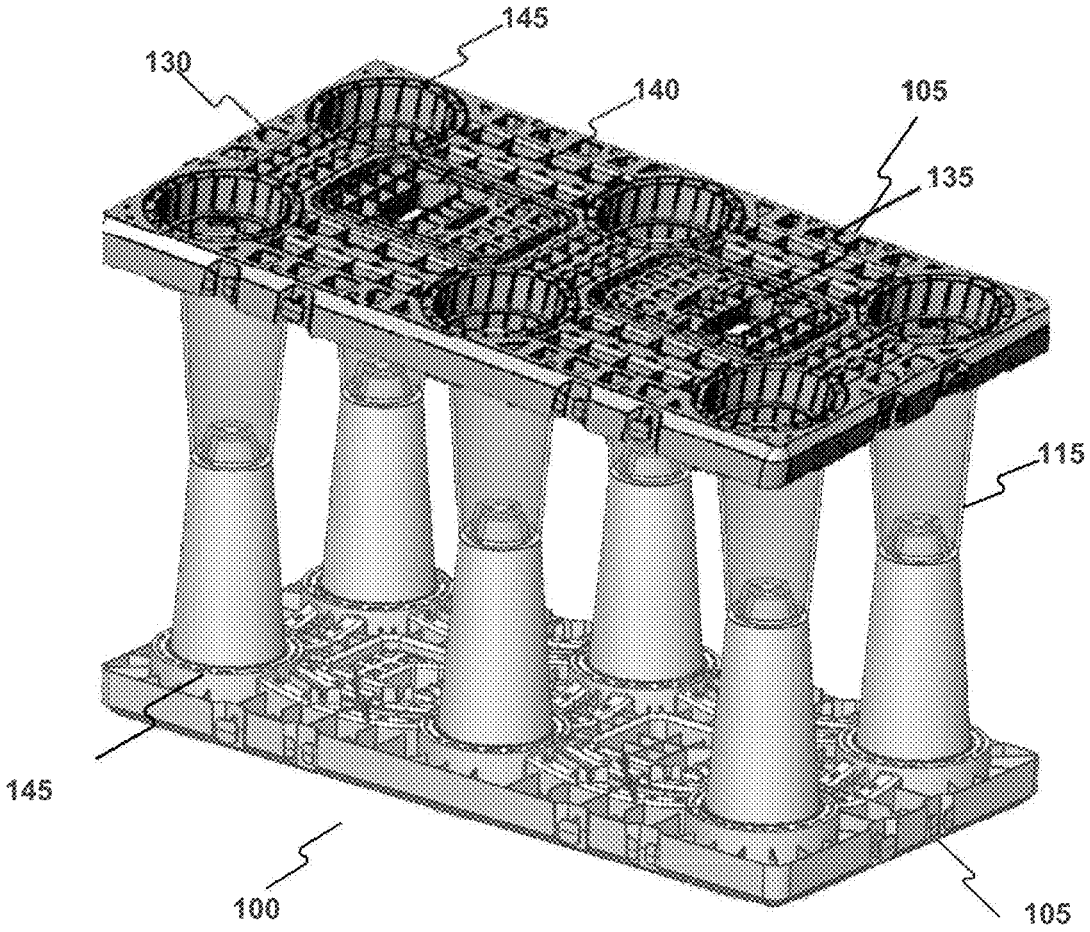
FIG. 1A depicts an isometric view of a stormwater management crate, consistent with various embodiments of the present disclosure.

Embodiments are described with reference to the accompanying drawings. In the figures, which are not necessarily drawn to scale, the left-most digit(s) of a reference number identifies the figure in which the reference number first appears. Wherever convenient, the same reference numbers are used throughout the drawings to refer to the same or like parts. While examples and features of disclosed principles are described herein, modifications, adaptations, and other implementations are possible without departing from the spirit and scope of the disclosed embodiments. Also, the words "comprising," "having," "containing," and "including," and other similar forms are intended to be equivalent in meaning and be open ended in that an item or items following any one of these words is not meant to be an exhaustive listing of such item or items or meant to be limited to only the listed item or items. It should also be noted that as used in the present disclosure and in the appended claims, the singular forms "a," "an," and "the" include plural references unless the context clearly dictates otherwise.

A need has been recognized to improve the efficiency in assembling stormwater management crate assemblies. Existing crate-type water management systems require intensive labor to assemble on a project site. It has been found that many of the components used to form the stormwater management crates are cumbersome and heavy to manipulate into place. Construction and assembly of the water management crates may be difficult when crate assembly components such as the plates and the column assemblies are loosely connected during initial assembly. Separable connections may inadvertently disconnect, destabilizing the structural integrity of the stormwater management crate. Rigid connections between crate assembly plates and column assemblies that do not allow flexing or rotation of the column assemblies may place critical stress on the column assemblies during assembly or after installation of the stormwater management crates, leading to damage to the column assemblies.

The disclosed embodiments improve these and other deficiencies in crate-type water management systems. For example, solutions are provided to reduce labor and assembly costs by reducing the weight of the stormwater management crate plate component through structural design improvements and to allow for easier field assembly of the crate assembly. Other improvements may include increasing strength and durability of the crate components while maximizing the void space in the assembly suitable for storing stormwater. Some disclosed embodiments may include improved connections between support column assemblies and plates to permanently affix the plates and the column assemblies during assembly, while also providing for rotation of the column assemblies to mitigate damaging stress forces on the column assemblies during assembly or after installation. In addition, some disclosed embodiments may allow for some components of the modular crate assemblies to be pre-assembled prior to arrival at a project site and configured for ease of final assembly upon arrival to the site to streamline and improve the construction process.

Reference will now be made in detail to the disclosed embodiments, examples of which are illustrated in the accompanying drawings.

FIG. 1A depicts an embodiment of a stormwater management crate, consistent with various embodiments of the present disclosure. Stormwater management crate 100 may include one or more plates 105. In some embodiments plate 105 may be constructed of plastic (e.g., polypropylene, HDPE, LDPE, PVC, polyethylene, polyurethane), metal, and/or any other suitable material. Plastic embodiments of plate 105 may be formed, for example, through injection molding, blow molding, CNC machining, vacuum forming, polymer casting, 3D printing, extrusion, rotational molding, or any other suitable means. In some embodiments, plate 105 is configured to support structural loads, such as dead and live loads resulting from earthen embankments, surface loads, parking lots, structures, vehicular loads, for example the American Association of State Highway and Transportation Officials (AASHTO) H-20 loading criteria, and/or walking loads. The thickness or gauge of plate 105 may be determined by the structural load bearing requirements needed for the particular plate. Other plates within a stormwater management crate assembly may be configured to support a walking live load only may be lighter in weight than a plate 105 configured to support additional live and dead structural loads.

In one embodiment, stormwater management crate 100 includes two plates 105, a top plate and a bottom plate, the bottom plate being located below the top plate. The two plates 105 may be used interchangeably in a stormwater management crate 100. For example, plate 105 located on the bottom of stormwater management crate 100 may be similar to plate 105 located on the top of stormwater management crate 100, except that the bottom plate is flipped upside down compared to the top plate. Use of interchangeable plates improves efficiency in the manufacturing and assembly of stormwater management crates.

The example of stormwater management crate 100 depicted in FIG. 1A may include support column assemblies 115. Support column assemblies 115 may be located between plates 105 in stormwater management crate 100. Support column assemblies 115 may be constructed of plastic (e.g., polypropylene, HDPE, LDPE, PVC, polyethylene, polyurethane), metal, glass reinforced materials, and/or any other suitable material. In one embodiment, support column assemblies 115 are formed of schedule 40 PVC. In another embodiment, support column assemblies are formed of glass filled polypropylene. In another embodiment, support column assemblies are formed of glass filled polyethylene. Support column assemblies 115 may be of a dissimilar material than plates 105. Support column assemblies 115 may be manufactured to various lengths and may include in a non-limiting example, lengths of approximately 20 inches to 90 inches. Support column assemblies 115 may be assembled from two support column portions as disclosed herein, for example support column portion 117 as shown in FIG. 1D.

Figure 1B:
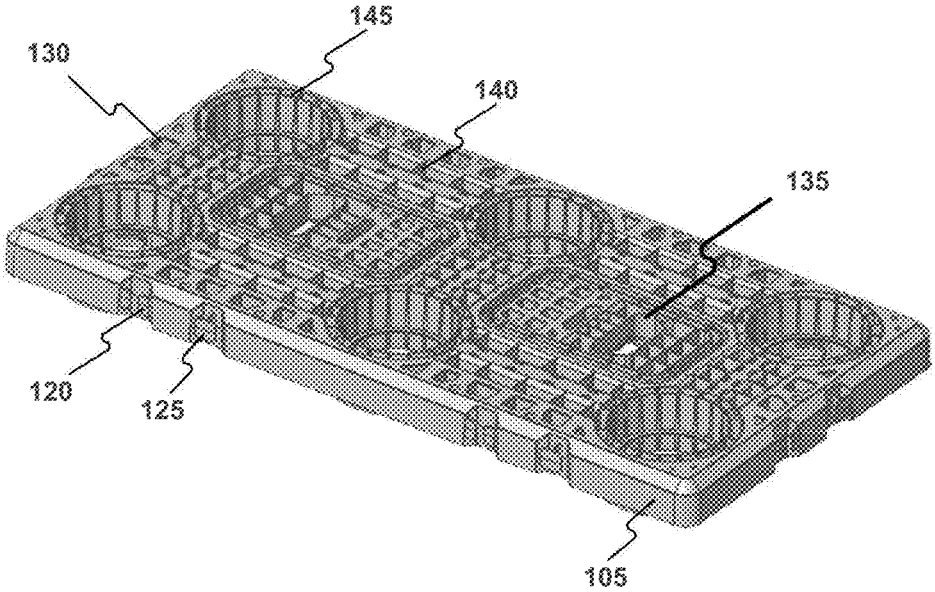
FIG. 1B depicts an isometric view of a plate, consistent with various embodiments of the present disclosure.

FIG. 1B depicts a plate 105 viewed from the top. Plate 105 may include a plurality of column connection recesses 145. Column connection recesses 145 connect support column assemblies 115 to top plate 105. In one embodiment, column connection recesses 145 comprise a bayonet attachment as described herein.

In some embodiments, plate 105 may include a plurality of slot locks 120 and hook locks 125. Slot lock 120 and hook lock 125 may be configured to interface with an adjacent plate 105, such that the slot lock 120 of each adjacent plate 105 may securely connect to hook lock 125 of the adjacent plate 125. In this way, plate 105 of stormwater management crate 100 may securely connect to an adjacent plate 105 of a second stormwater management crate 100, such as the stormwater management crate array 600 depicted in FIG. 6B.

Plate 105 may include lattice member 130. In some embodiments, lattice member 130 may provide a walking platform suitable for assembly crews to construct stormwater management crate 100. Lattice member 130 may include perforations as depicted in FIG. 1B. The perforations may be designed to reduce the weight of plate 105 while maintaining sufficient structural integrity to support a walking load on plate 105. Plate 105 may also include hand grip 135. Hand grip 135 may be formed to allow a single person to grip and lift plate 105.

Plate 105 may include support member 140. Support member 140 may provide structural support and integrity to connect the column connection recesses 145 together into plate 105. For example, FIG. 1B depicts six column connection recesses 145. The column connection recesses 145 are connected by various support members 140. Though the plate 105 depicted in FIG. 1B includes six column connection recesses 145, plate 105 may comprise more or fewer column connection recesses 145. For example, plate 105 may include four, eight, or any other number of column connection recesses 145. Support members 140 may vary in length to create various configurations and sizes of plate 105 and stormwater management crate 100 and may include lengths of approximately twenty inches to approximately ninety inches, though shorter or longer lengths may be used in certain situations to fit specific site conditions.

Figure 1C:
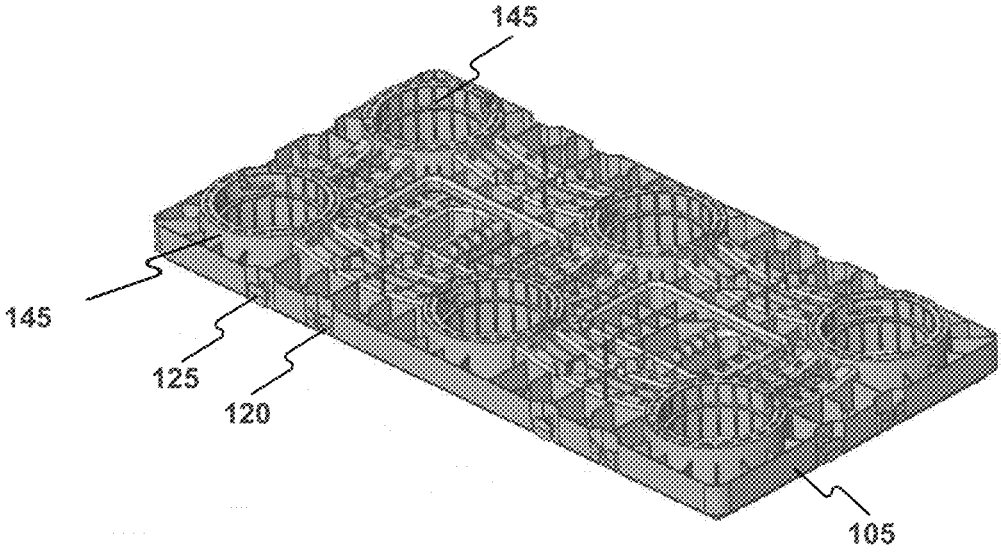
FIG. 1C depicts an isometric view of a plate flipped upside down, consistent with various embodiments of the present disclosure.
Figure 1D:
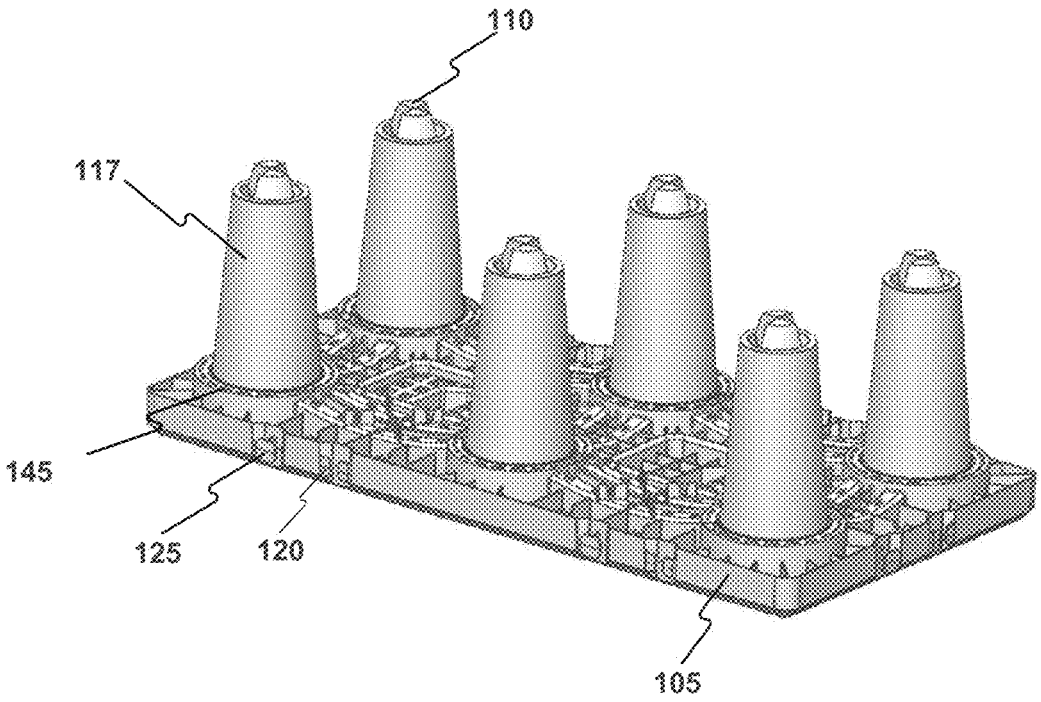
FIG. 1D depicts an isometric view of a plate flipped upside down with support column portions, consistent with various embodiments of the present disclosure.

FIG. 1C depicts a plate 105 flipped upside down and viewed from the bottom. As shown in FIG. 1C, one embodiment of plate 105 includes six column connection recesses 145, each column connection recess 145 capable of connecting a support column assembly 115 (not shown in FIG. 1C) to the plate 105.

Figure 5:
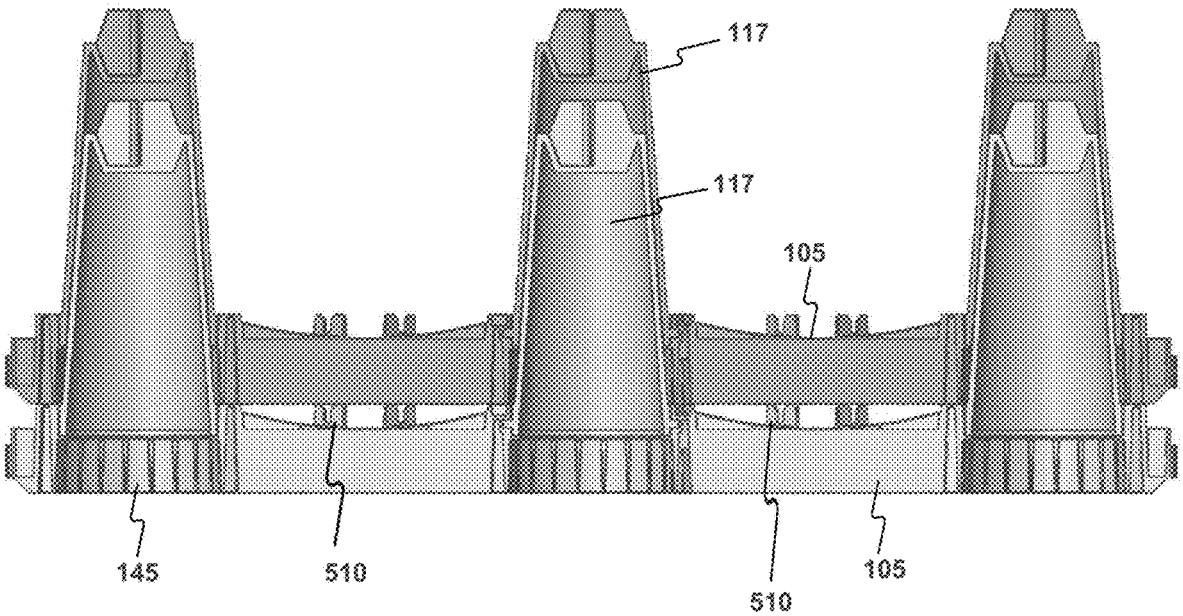
FIG. 5 depicts two plates stacked for storage and transport, consistent with various embodiments of the present disclosure.

FIG. 1D depicts a plate 105 viewed from the bottom with support column portions 117 connected to plate 105 at column connection recesses 145. As shown in FIG. 1D, support column portions 117 may be attached to plate 105 at column connection recesses 145. Support column portions 117 may be tapered in shape as shown in FIG. 1D and assembled into tapered shaped support column assemblies 115 as shown in FIG. 1A. Tapered shaped support column assemblies may solve problems in the art of stormwater management crate assemblies. For example, partially assembled stormwater management crates with tapered support column assemblies may be stacked in a nesting arrangement, for example as shown in FIG. 5, allowing compact shipment and transport of stormwater management crates to a project site. This reduces shipping and assembly costs. Support column assemblies 115 are not limited to tapered shapes, and may, in other embodiments, be square, triangular, cylindrical, or rectangular shaped. Similarly, column connection recesses 145 may correspond to these alternative shapes of support column assembly 115 and may also be square shaped, triangular shaped, rectangular shaped, or any other shape to interface with a corresponding support column assembly 115. The shape of the support column assembly 115 and the column connection recess 145 may dictate the type of connection used between the support column assembly 115 and column connection recess 145. For example, a bayonet connection 205, an embodiment shown in FIGS. 2A and 2B, may be used with cylindrical shaped support column assemblies 115. Alternative shaped support column assemblies 115 may be unable to use bayonet connections 205 and may require snap connections or other connection types, such as the snap connection embodiment shown in FIGS. 2E and 2F. In one embodiment, support column assemblies 115 connect to plate 105 at column connection recesses 145 through use of bayonet connections as described herein. Use of a bayonet connection may form a secure connection between support column assembly 115 and plate 105. For example, support column assembly 115 may be securely connected to plate 105 such that the secure connection cannot be defeated through the use of conventional force by a stormwater crate assembly worker, such as pulling or rotating support column assembly 115 by hand. In some embodiments, after a secure connection has been made between a support column assembly 115 and a plate 105, the support column assembly 115 and plate 105 can only be separated through the use of tools or destructive methods such as prying, sawing, or similar techniques.

In one embodiment, at least one support column assembly 115 is separable into two support column portions 117 and may include an upper portion and a lower portion. The upper portion and the lower portion of the at least one support column assembly 115 may connect to each other through the use of a snap connection, such as snap connection 110 described herein. For example, FIG. 1D depicts a plate 105 placed upside down with support column portion 117 attached to plate 105. In this arrangement, plate 105 acts as a bottom plate and support column portion 117 acts as a lower portion of the support column assembly 115 in an assembled stormwater management crate 100. Plate 105 may be flipped over to act as a top plate. In such an arrangement, support column portion 117 acts as an upper portion of the support column assembly 115.

Figure 1E:
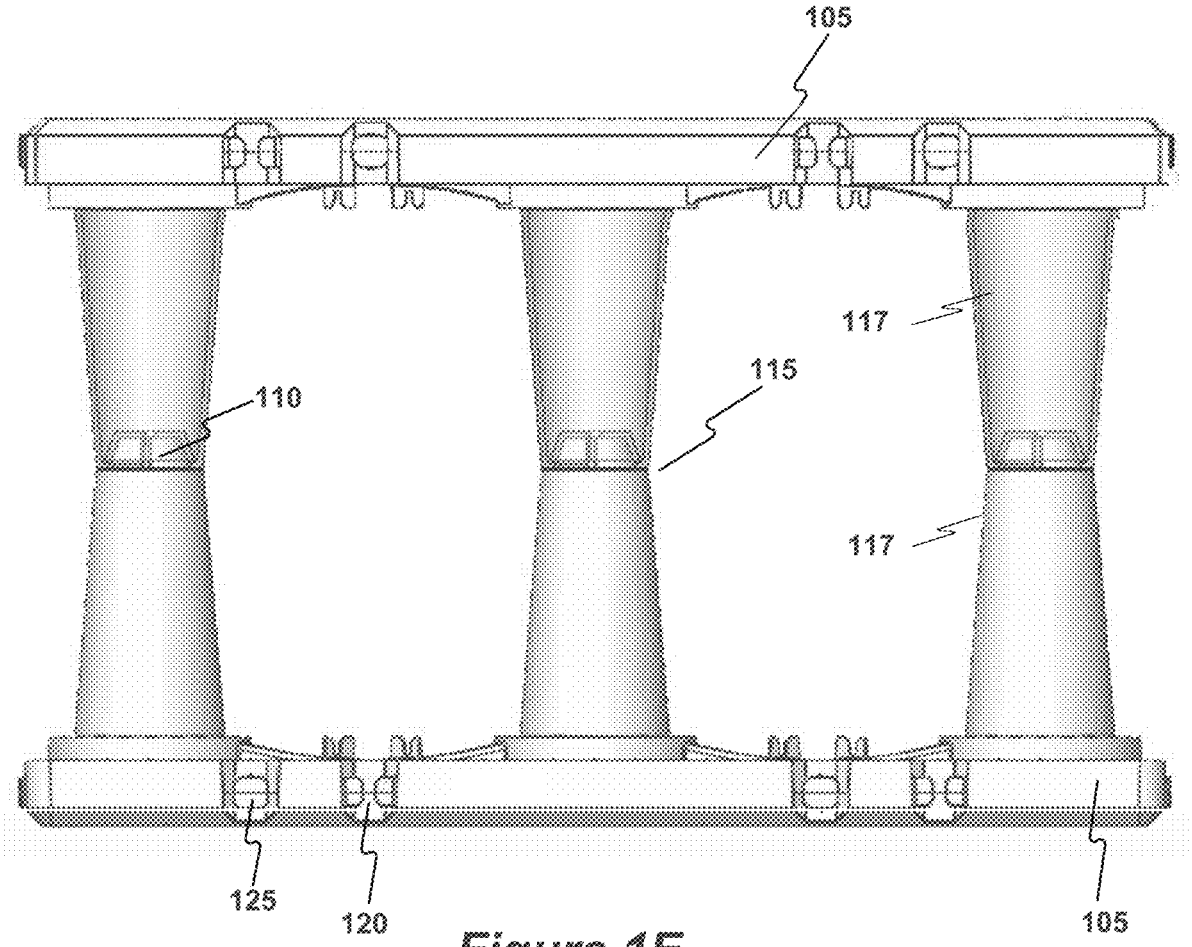
FIG. 1E depicts a side view of a stormwater management crate, consistent with various embodiments of the present disclosure.

FIG. 1E depicts stormwater management crate 100 viewed from the side. As shown in FIG. 1E, a stormwater management crate 100 may be formed by attaching a plate 105 and its attached support column portions 117 located on the top of the stormwater management crate 100 to another plate 105 and its attached support column portions 117 located on the bottom of the stormwater management crate 100. The upper support column portion 117 may connect to the lower support column portion 117 forming a support column assembly 115 using snap connection 110.

Figure 2A:
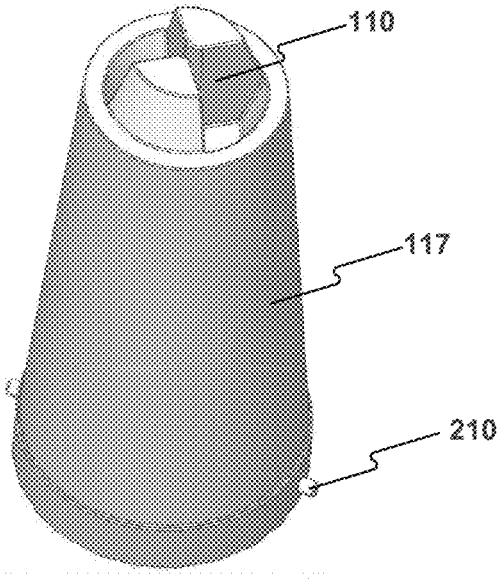
FIG. 2A depicts a support column portion, consistent with various embodiments of the present disclosure.

FIG. 2A depicts an embodiment of a support column portion 117. Support column portion 117 may include snap connection 110 as further depicted in FIG. 3A. Snap connection 110 may be configured to interface with another support column portion 117 to securely connect the two support column portions 117 into a support column assembly 115. In one embodiment, support column portion 117 contains support column pin 210. Support column pin 210 may extend outside of opposite sides of support column portion 117 and may be configured to interface with a bayonet connection. For example, support column pin 210 may be positioned to pass underneath rib 220 of bayonet connection 205 to thereby attach support column portion 117 to a plate 105, as described herein. Support column pin 210 may be made of a dissimilar material from support column portion 117. For example, support column pin 210 may be made of metal. Support column pin 210 may be integrally formed in support column portion 117. In one embodiment, support column portion 117 is formed using injection molded techniques and support column pin 210 is integrated into support column portion 117 as part of the injection molding process. In another embodiment, support column pin 210 is installed in support column portion 117 after support column portion 117 has been fabricated.

Figure 2B:
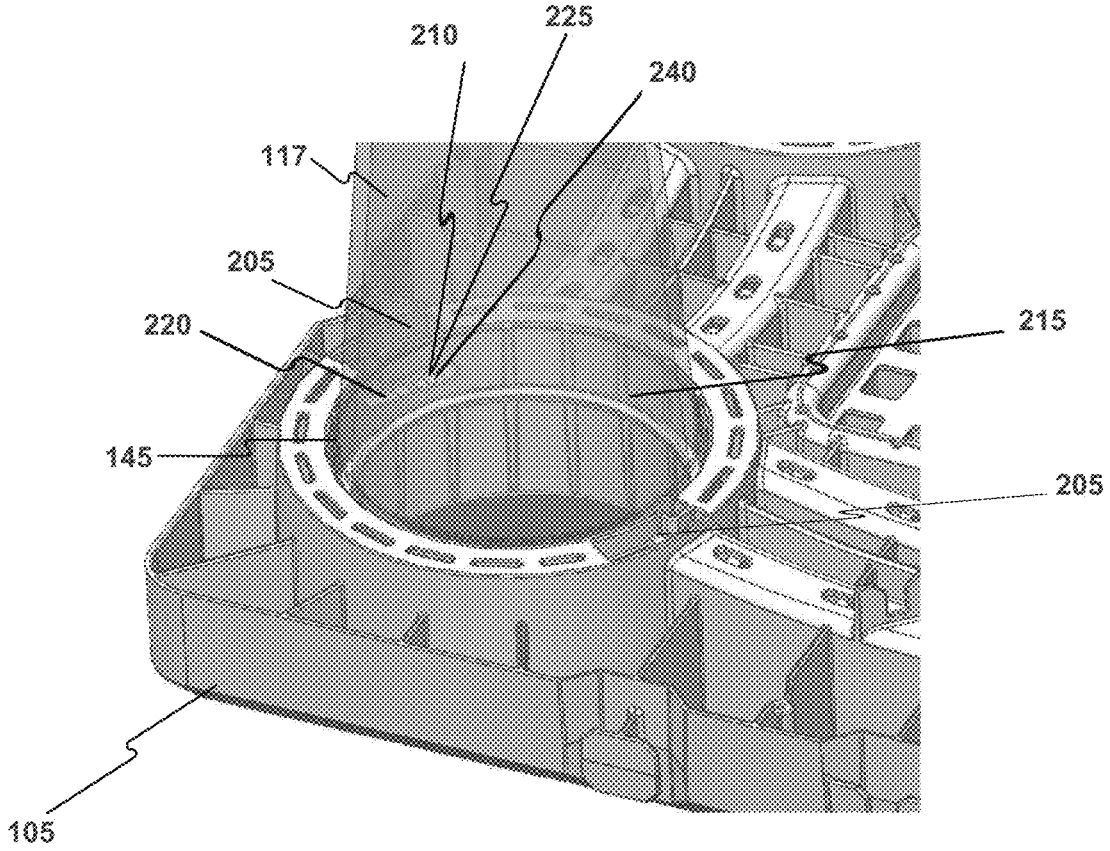
FIG. 2B depicts a bayonet connection in a plate with a support column portion, consistent with various embodiments of the present disclosure.

FIG. 2B depicts a support column portion 117 connected to plate 105 at column connection recess 145 using a bayonet connection 205. In some embodiments, a user may seek to attach support column portion 117 to plate 105. Support column portion 117 may include a support column pin 210 that extends out of two, opposite sides of support column portion 117. To attach support column portion 117 to plate 105, the user may insert the support column portion 117 into the column connection recess 145 so that the ends of the support column pin 210 slide into each of the pair of slots in two bayonet connections 205 situated on opposite sides of column connection recess 145. The user may then rotate support column portion 117 so that support column pin 210 located on each side of the support column pass underneath rib 220 in each of the two bayonet connections 205 situated on opposite sides of column connection recess 145. In each bayonet connection 205, upon passing support column pin 210 underneath rib 220, support column pin 210 is locked inside bayonet connection 205. The user may continue to rotate support column portion 117 and support column pin 210 until support column pin 210 slides over guide rib 240 and seats into detent 225. Once seated in detent 225, support column portion 117 may be rotated approximately six degrees in a clockwise or counterclockwise direction. Rotation is enabled because support column pin 210 may freely rotate until it encounters bayonet slot wall 245, which prevents further movement of support column pin 210 within detent 225. Such connection features may aid in the assembly of stormwater management crates 100. For example, affixing support column portion 117 to plate 105 may prevent unwanted or accidental separation of the support column assemblies 115 from the plate during assembly of the stormwater management crates, improving user safety and the speed and efficiency of the assembly operation. In addition, the rotation allowance provided by guide rib 240 may prevent unwanted torsional stress and strain on support column assemblies 115 during or after installation. For example, rigid connections may resist minor rotational forces applied to support column assemblies 115 during or after installation, resulting in unwanted damage or fractures to support column assemblies 115. Bayonet slot wall 245 may prevent such damage by allowing minor rotation of support column assembly 115 while also keeping support column assembly 115 permanently affixed within column connection recess 210. Though FIG. 2B depicts an embodiment with two bayonet connections 205, column connection recesses 145 are not limited to two bayonet connections 205. Arrangements featuring one, three, four, or more bayonet connections 205 may be used in connection with fewer or additional support column pins 210.

Figure 2C:
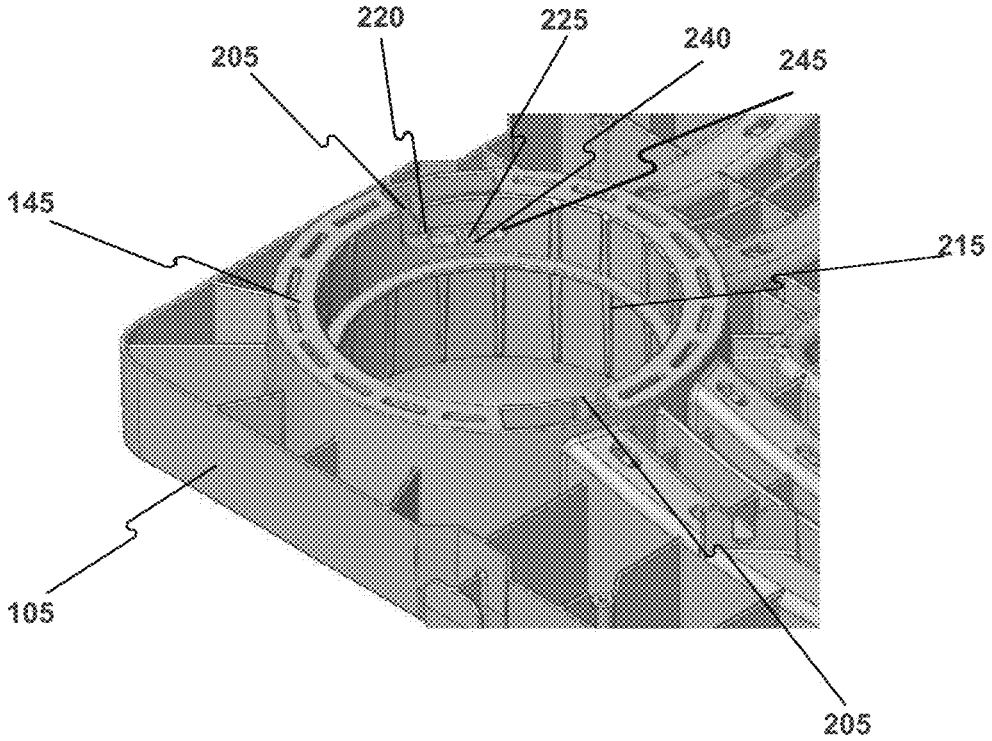
FIG. 2C depicts a bayonet connection in a plate, consistent with various embodiments of the present disclosure.

FIG. 2C depicts an embodiment of a bayonet connection with the support column portion 117 and support column assembly 115 omitted for clarity. As shown in FIG. 2B, two bayonet connections 205 located at opposite sides of support column recess 145 may be used to secure a single support column portion 117 to plate 105 by engaging with each end of column pin 210. In some embodiments, column connection recess 145 may include one or more column connection recess ribs 215, as shown in FIG. 2C. One or more column connection recess ribs 215 may be spaced around the perimeter of column connection recess 110. Column connection recess ribs 215 may be equally spaced around the perimeter of column connection recess 145 or may have irregular spacing. Column connection recess ribs 215 may act as linear guides that direct support column portion 117 into column connection recess 145. In some embodiments, column connection recess ribs 215 may deflect under pressure, creating a dimensional allowance, or tolerance, for support column portion 117 to interface with column connection recess 145.

Figure 2D:
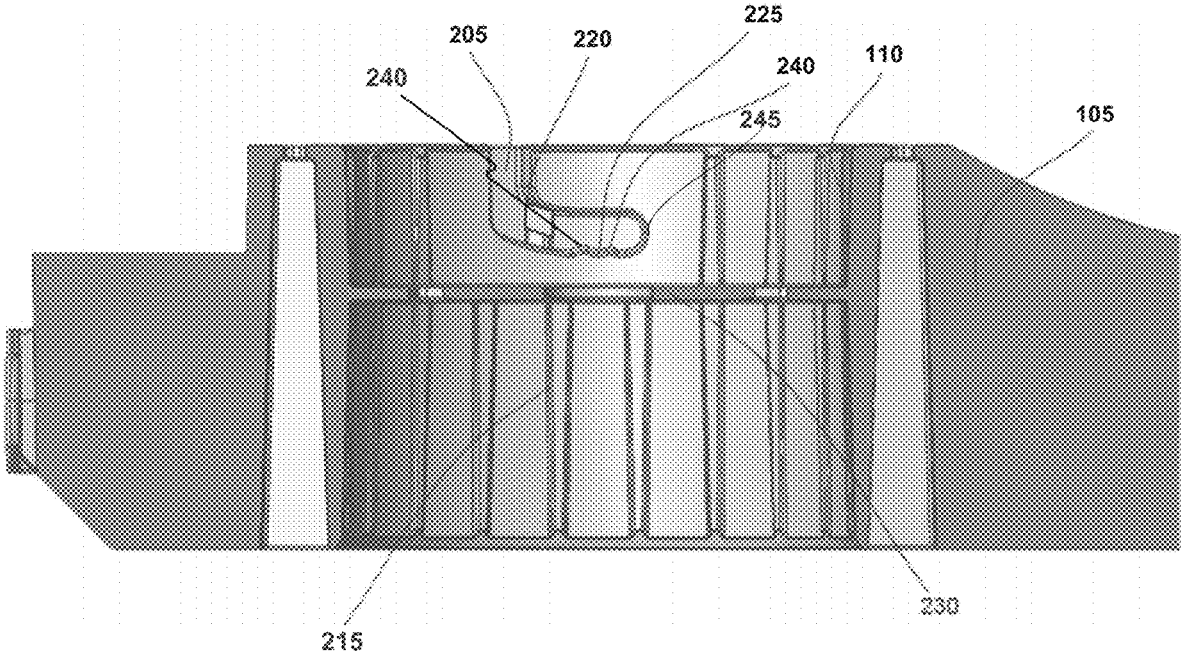
FIG. 2D depicts a section view of a bayonet connection in a plate, consistent with various embodiments of the present disclosure.

FIG. 2D depicts a section view of a column connection detail of an embodiment of a bayonet connection 205. Bayonet connection 205 may include rib 220, detent 225, and rotational guide 240. As shown in FIG. 2D, column connection recess 145 may include column rest 230 to act as a barrier to prevent support column portion 117 and thereby support column assembly 115 from passing through column connection recess 110 or top plate 105. Support column rest 230 may act as a barrier to prevent support column assembly 115 from passing through column connection recess 145 or plate 105. Support column rest 230 may also act as a load bearing platform in that vertical loads carried by plate 105 are transferred to support column assembly 115 through contact with support column rest 230.

Figure 2E:
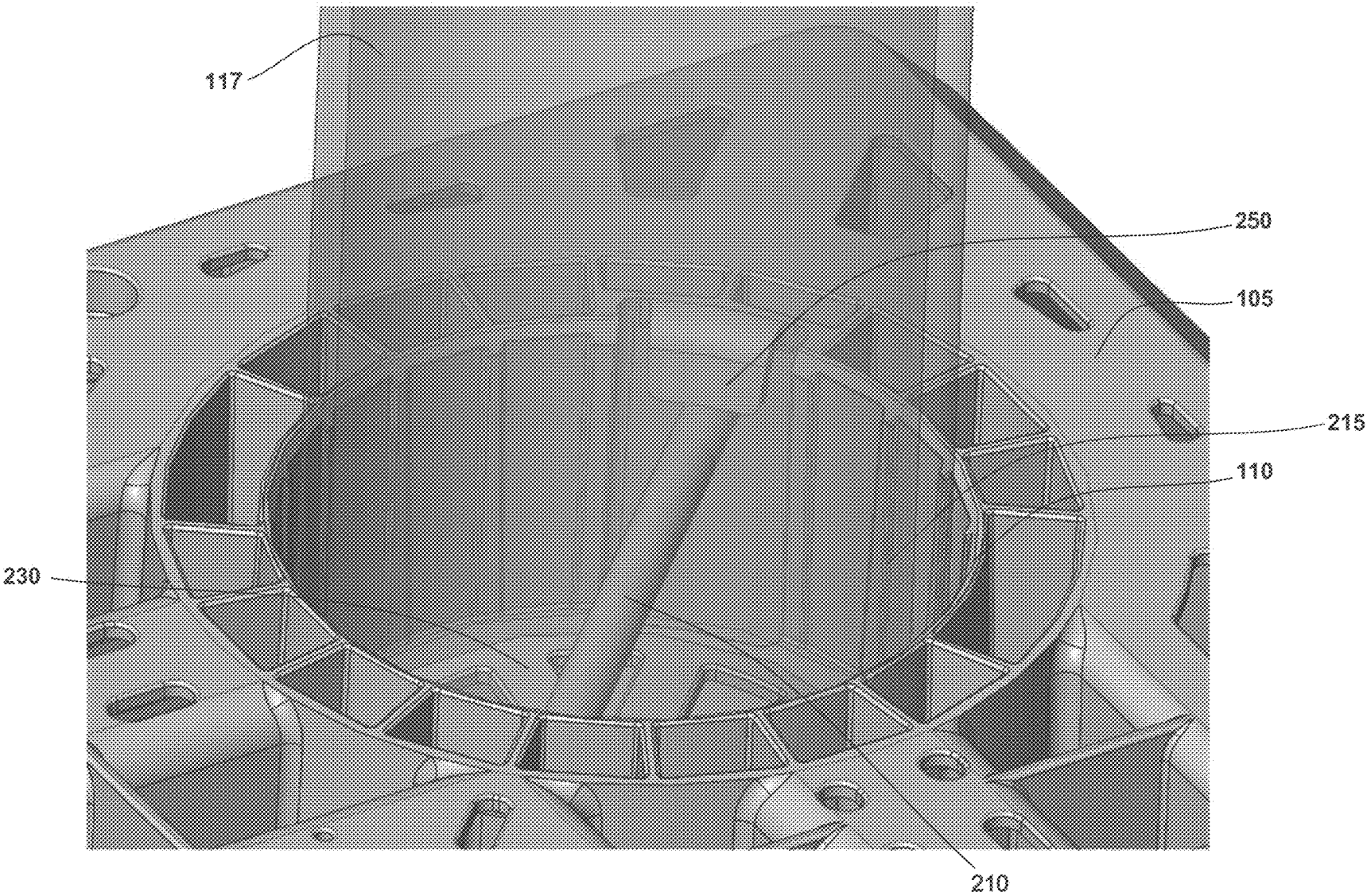
FIG. 2E depicts a column detail of an example of a stormwater management crate using a snap connection, consistent with various embodiments of the present disclosure.

FIG. 2E depicts a detailed view of another embodiment of column connection recess 110 featuring snap connection 250. In some embodiments, support column portion 117 may include support column pin 210 where support column pin 210 which extends out of one or more sides of support column portion 117. To attach support column portion 117 to top plate 105, the user may insert support column portion 117 into column connection recess 110 so that the exposed end of support column pin 210 aligns with snap connection 250. As support column pin 210 is pushed against snap connection 250, snap connection 250 may temporarily deflect due to the pressure applied from the connection with support column pin 210. Once support column pin 210 is pushed below snap connection 250, snap connection 250 springs back into its original position, affixing support column pin 210 into place and securely connecting top plate 105 and support column portion 117, as shown in FIG. 2E.

As show in FIG. 2E, column connection recess 110 may include support column rest 230. Support column rest 230 may act as a barrier to prevent support column 115 from passing through column connection recess 110 or top plate 105. Support column rest 230 may also act as a load bearing platform in that vertical loads carried by top plate 105 are transferred to support column 115 through contact with support column rest 230.

Figure 2F:
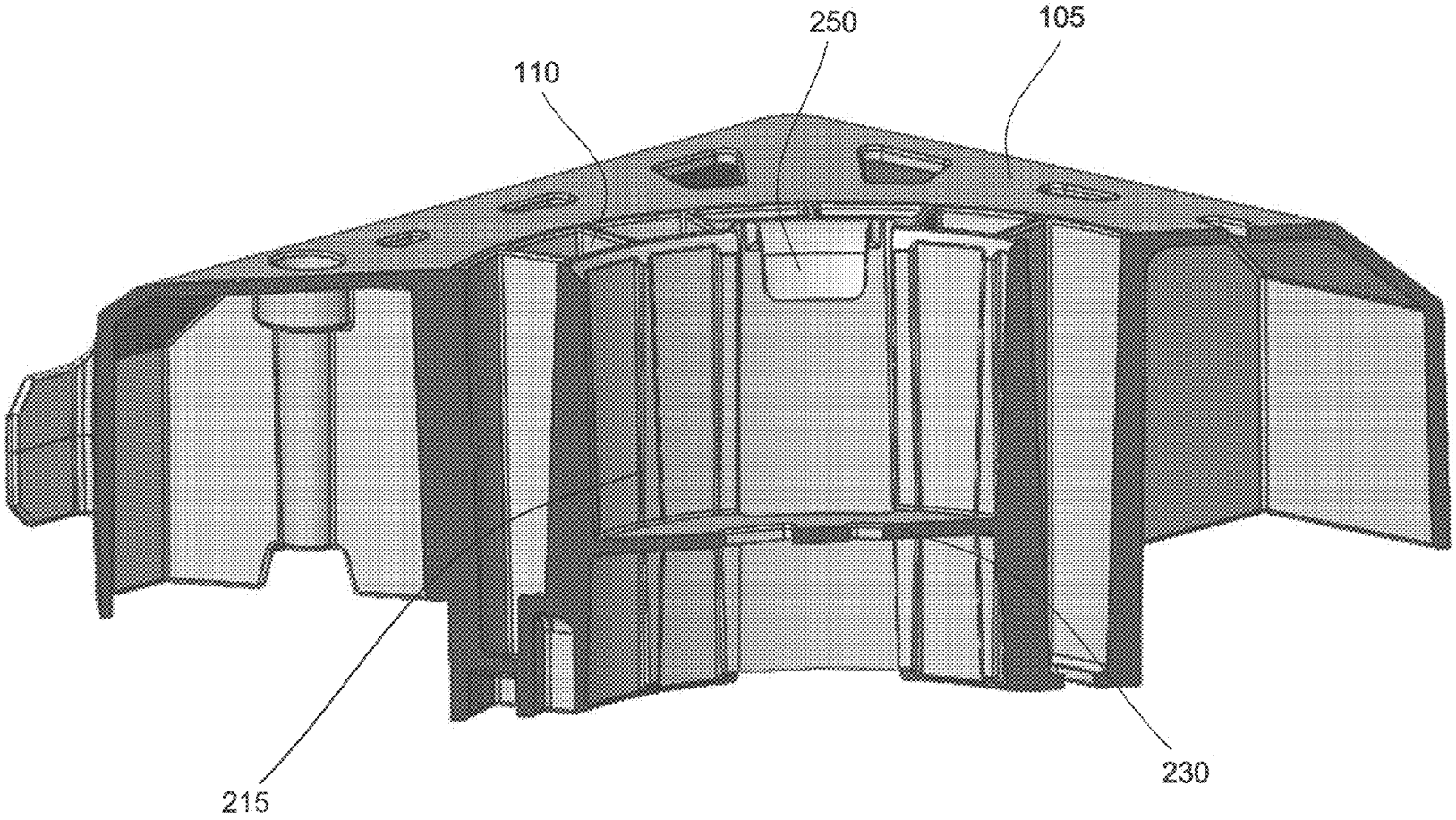
FIG. 2F depicts a cross section view of a snap connection of an example of a stormwater management crate, consistent with disclosed embodiments.
Figure 6A:
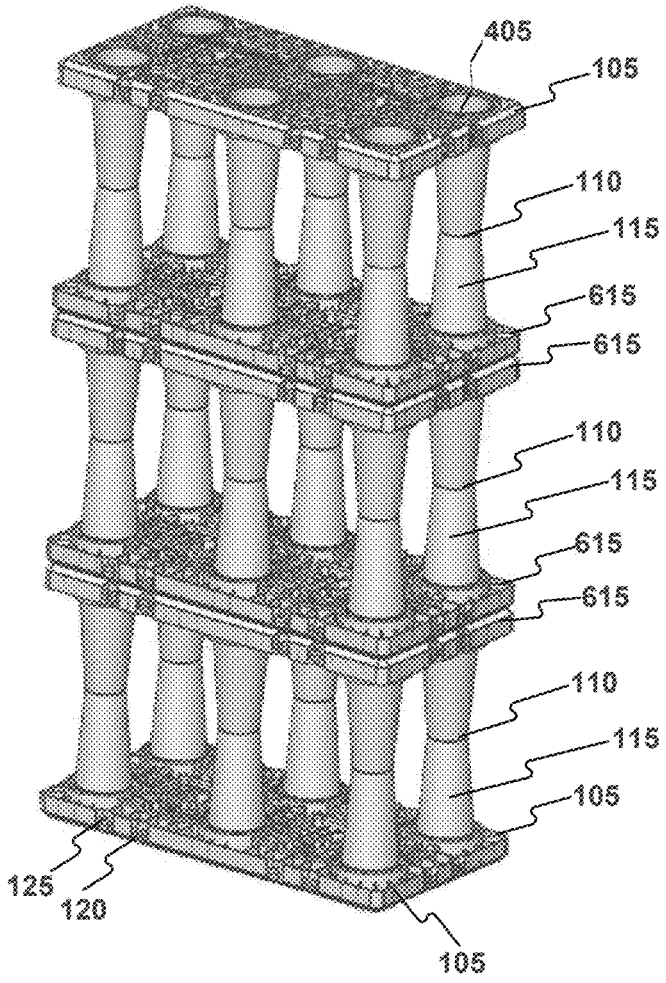
FIG. 6A depicts a stormwater management crate assembly with the side panels omitted for clarity, consistent with various embodiments of the present disclosure.
Figure 6B:
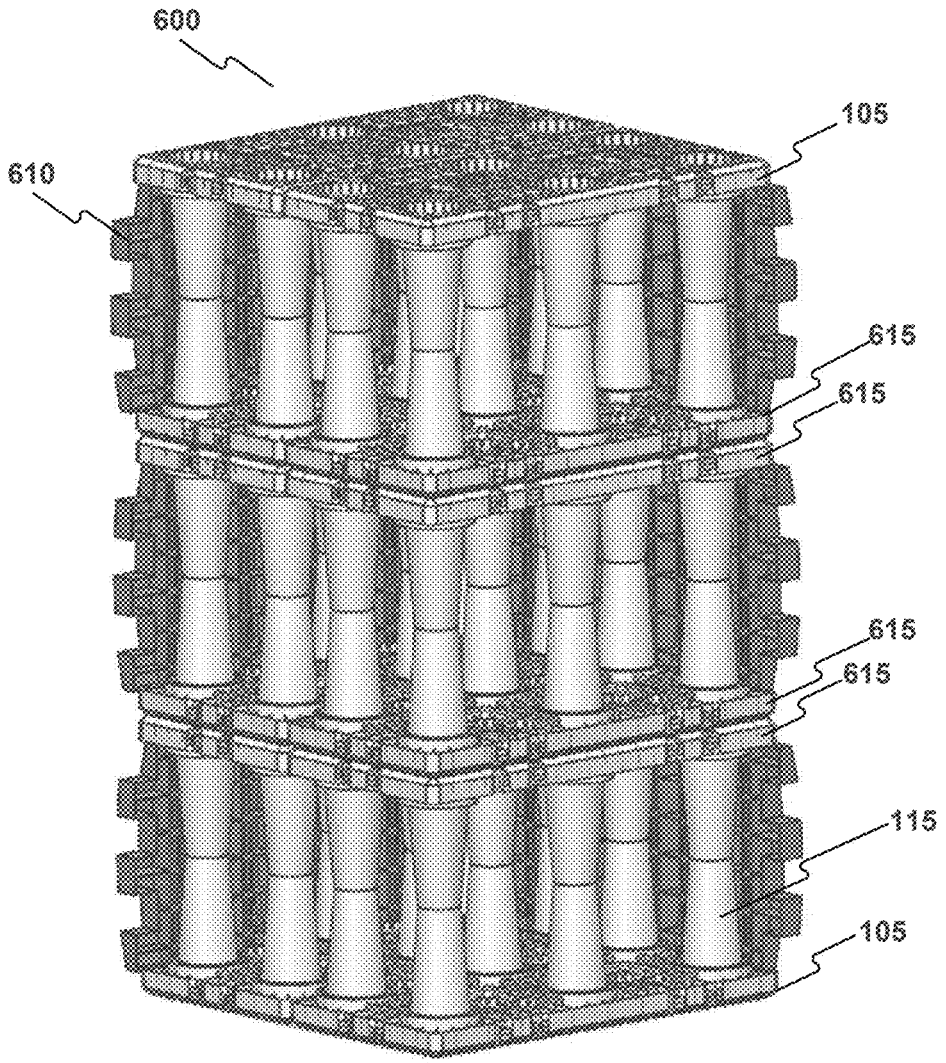
FIG. 6B depicts a stormwater management crate assembly, consistent with various embodiments of the present disclosure.

FIG. 2F depicts a cross section view of one embodiment of column connection recess 110 featuring snap connection 250. As shown in FIG. 2F, column connection recess ribs 215 may extend on either side of support column rest 230. In some embodiments, two support columns 115 (not shown in FIG. 2F) may interface with column connection recess 110 on either side of support column rest 230. For example, two support columns 115 may interface with column connection recess 110 on either side of support column rest 230 when multiple stormwater management crates are stacked into a stormwater management crate array 600, as shown in FIG. 6B.

Figure 3A:
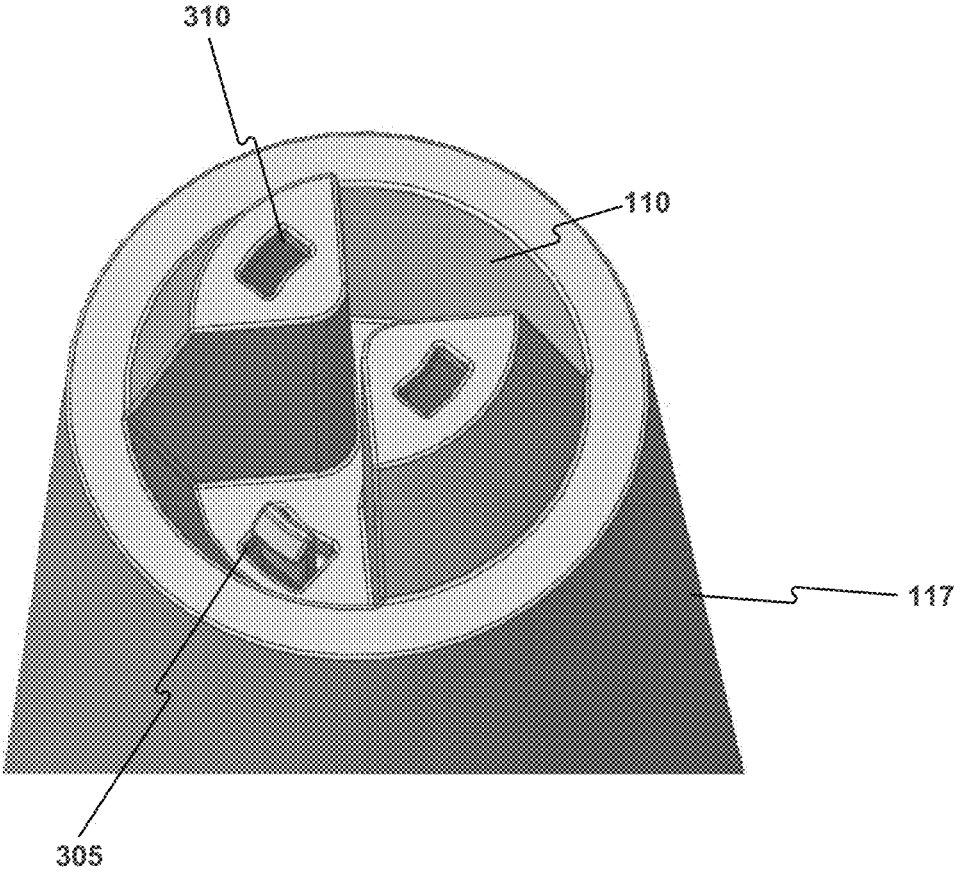
FIG. 3A depicts a column snap connection, consistent with various embodiments of the present disclosure.

FIG. 3A depicts a close up view of an embodiment of a snap connection 110. In some embodiments, snap connection 110 may serve to connect two support column portions 117, an upper portion and a lower portion, to form support column assembly 115. Snap connection 110 may include one or more snap connection hook 305 and one or more snap connection slot 310. Snap connection hook 305 may be arranged to correspond with snap connection slot 310 on another support column portion 117. In an embodiment, snap connection 110 includes two snap connection hooks 305 and two snap connection slots 310. The two snap connection hooks 305 and two snap connection slots 310 may be arranged to correspond with two snap connection slots 310 and snap connection hooks 305 on another support column portion 117. In some embodiments, snap connection 110 may include one or more snap connection hook 305 and no snap connection slots 310. In other embodiments where interlocking support column portions 117 are not identical or symmetrical, snap connection 110 may include one or more snap connection slots and no snap connection hooks 305.

Figure 3B:
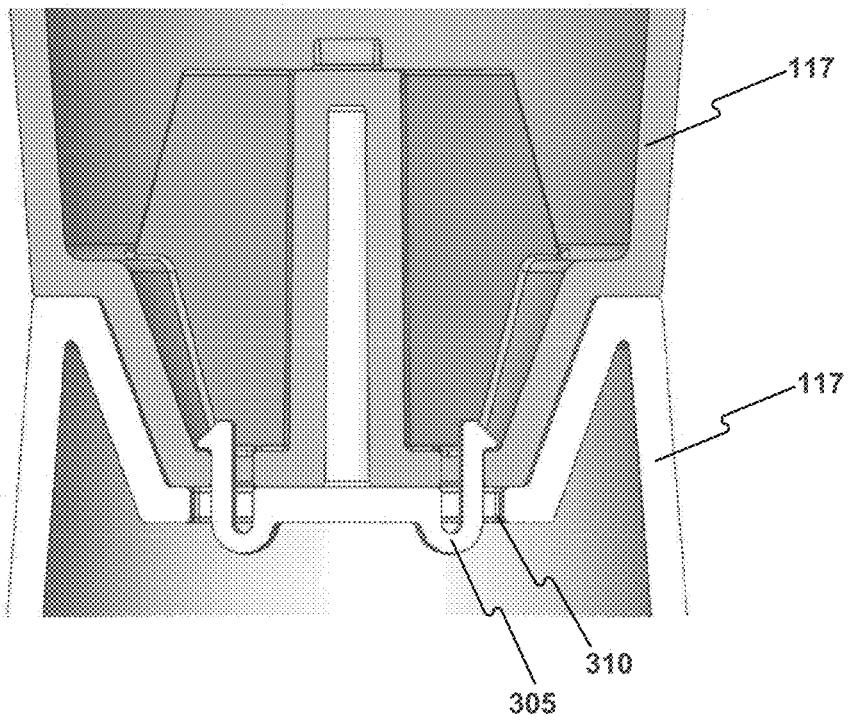
FIG. 3B depicts a section view of a column snap connection connecting an upper portion and a lower portion of a support column assembly, consistent with various embodiments of the present disclosure.

FIG. 3B depicts a section view of two support column portions 117 connected together using a snap connection. In one embodiment, to connect support column portions 117 together, the user may insert snap connection hook 305 from one support column portion into column connection slot 310 of a corresponding support column portion 117. As support column hook 305 is pushed against support column slot 310, support column hook 305 may temporarily deflect due to the pressure applied from the connection with support column slot 310. Once support column hook 305 is pushed through support column slot 310, support column hook 305 springs back into its original position, affixing support column hook 305 into place and securely joining support column portions 117 together, as shown in FIG. 3B. In one embodiment, support column portions 117 may be connected to plates 105 at a column connection recess 145 using, for example, a bayonet connection 205. Two plates 105 and their connected support column portions 117 may then be connected together into a stormwater management crate 100 by connecting the support column portions 117 together using the snap connection 110 as described herein.

Figure 4A:
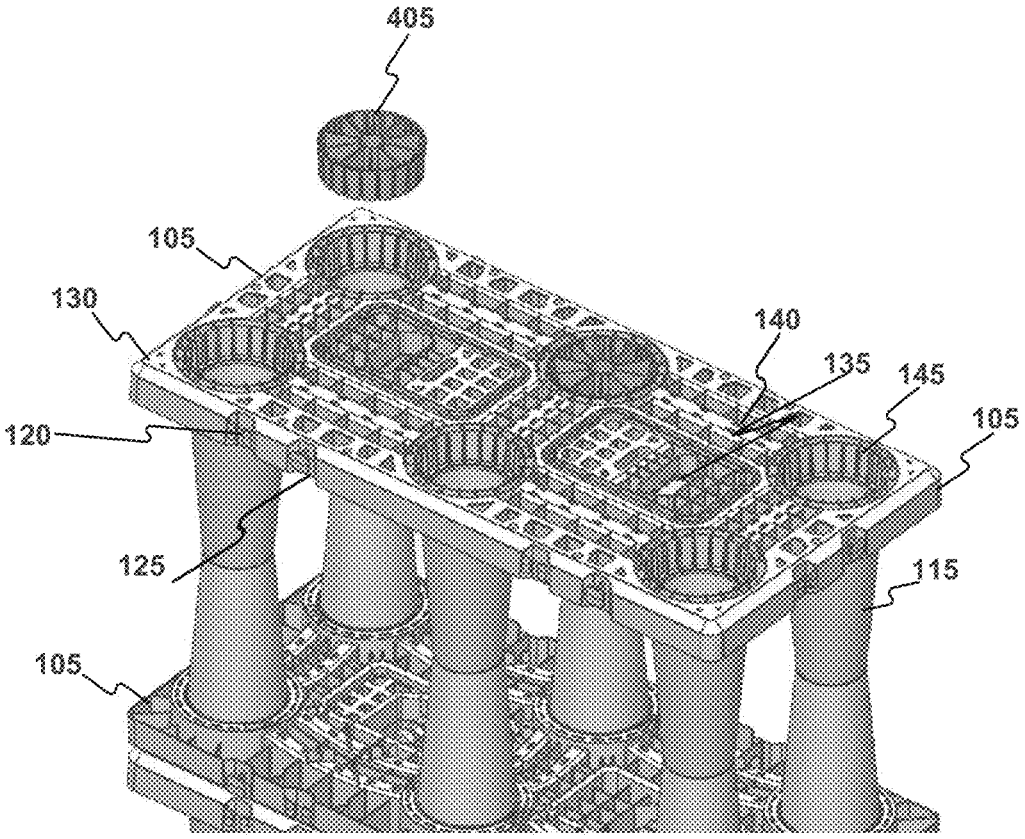
FIG. 4A depicts a stormwater management crate, consistent with various embodiments of the present disclosure.

FIG. 4A discloses an embodiment of a stormwater management crate 100 including column connection recess covers 405 in the plate 105. Column connection recess covers 405 may be configured to transfer vertical loads to support column assemblies 115 and to provide a stable walking surface. For example, stormwater management crate 100 may be buried underground or surrounded with an earthen embankment. Soil loads associated with the embankment or surfaces located above the stormwater management crate 100 may bear on the plate 105. These loads may be transferred to support column assemblies 115 through contact with column connection recess covers 405.

Figure 4B:
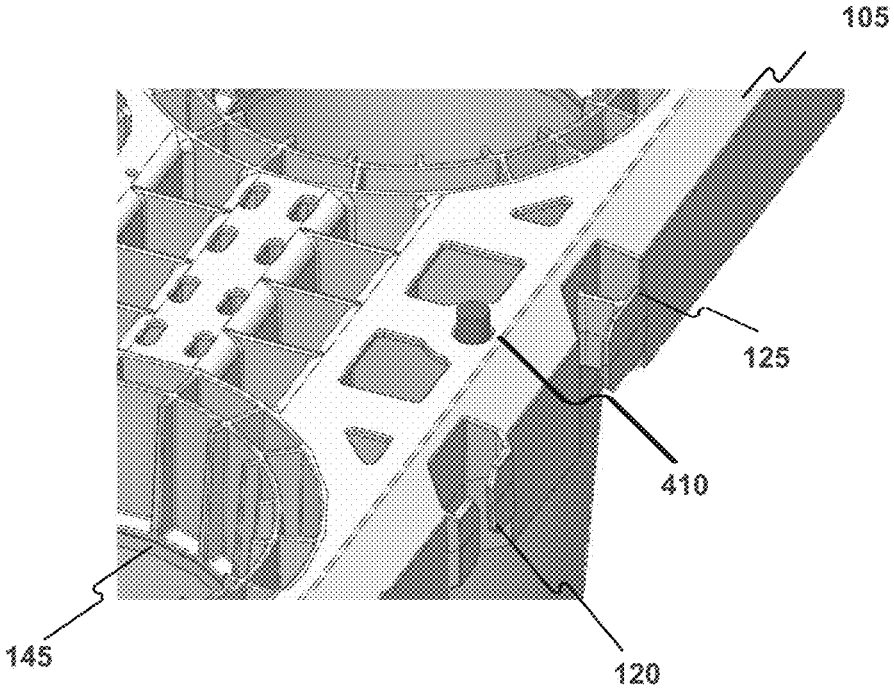
FIG. 4B depicts a detailed view of a plate, consistent with various embodiments of the present disclosure.
Figure 4C:
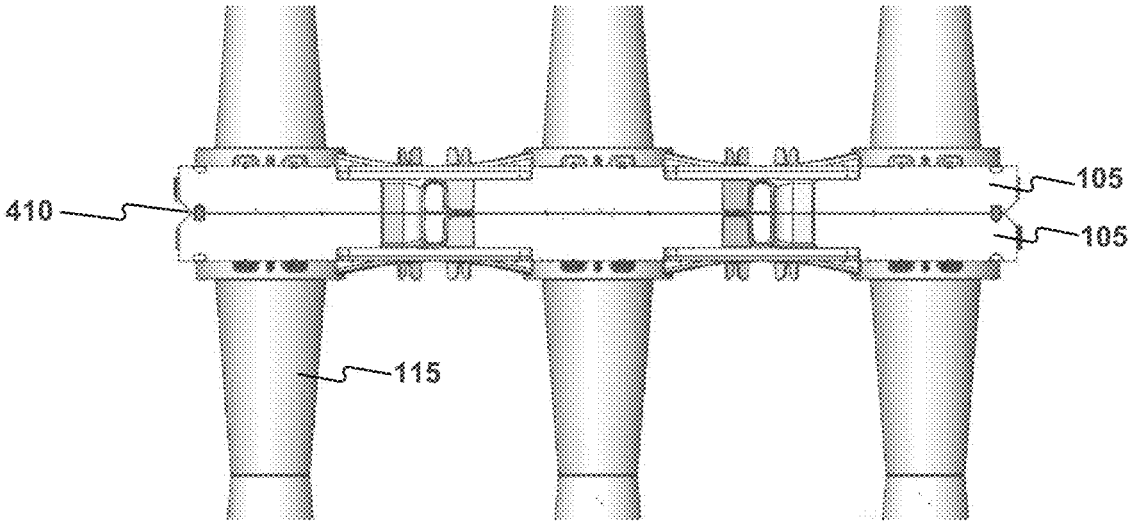
FIG. 4C depicts a side view of two stormwater management crates stacked vertically, consistent with various embodiments of the present disclosure.

In some embodiments, plate 105 may include one or more stabilization pins 410, as shown in FIG. 4B. Stabilization pins 410 may be integrated into the top side of plate 105 and configured to connect with a recess in the bottom of a second plate 105. For example, in an embodiment, stormwater management crates 100 may be stacked vertically on top of each other. Stabilization pins 410 may be used to resist lateral forces acting on stacked stormwater management crates 100 by connecting the stacked stormwater management crates 100 together, as shown in FIG. 4C. In one embodiment, stabilization pins 410 are made of dissimilar materials from plate 105. In another embodiment, stabilization pins 410 are formed integral to plate 105, such as by using injection molding techniques.

In some embodiments, one or more stormwater management crates 100 may be pre-assembled or partially pre-assembled and delivered to a project site. For example, FIG. 5 shows an embodiment of a stormwater management crate 100 where two plates 105 and their attached support column portions 117 may be stacked in a nesting arrangement for storage and transport. Plate 105 may include one or more stacking prongs 510. Stacking prongs 510 may be formed integrated to plate 105. Stacking prongs 510 may provide support to vertically stacked plates 105 and support columns 115 as shown in FIG. 5.

In other embodiments, multiple stormwater management crates 100 may be preassembled into a partial stormwater management array and delivered to a project site. For example, two or three stormwater management crates 100 may be vertically stacked and connected to each other by connecting support column portions 117 to column connection recesses 145. Such preassembled partial stormwater management arrays may then be further assembled into a stormwater management crate array at a project location by connecting upper and lower portions of support column portions 117 using snap connections 110.

Multiple stormwater management crates 100 may be stacked vertically. FIG. 6A depicts an embodiment where three stormwater management crates 100 are vertically stacked on top of each other. In this arrangement, each stormwater management crate is formed by connecting support column portions 117 to plates 105 at column connection recesses 145 using bayonet connections 205, and then connecting the support column portions 117 together at snap connection 110, creating support column assemblies 115 and forming three stormwater management crates 100. The three stormwater management crates 100 are then stacked vertically, using stabilization pins 410 between two vertically stacked stormwater management crates to provide lateral support. The top stormwater management crate 100 includes connection recess covers 405 in plate 105 at the top of the stormwater management crate 100 to fill the void space in the column connection recesses 145, provide structural reinforcement, and transfer vertical loads from the surface above the stacked stormwater management crates 100 down through the support column assemblies 115 to the lower-most plate 105.

In some embodiments, multiple stormwater management crates 100 may be assembled into stormwater management crate array 600. For example, FIG. 6B depicts an isometric view of a stormwater management crate array 600, with some side panels omitted for clarity. In some embodiments, the stormwater management crate array 600 may be formed by connecting multiple stormwater management crates together. For example, FIG. 6B depicts a stormwater management crate 600 comprising six stormwater management crates 100. At the uppermost layer, two separate plates 105 are linked together in a horizontal plane through slot connections 120 and hook connections 125. Each of the two top plates 105 includes six support column assemblies 115 connected to the plates 105 at column connection recesses 145. The support column assemblies 115 extend down therefrom and connect to two intermediate plates 615 below the support column assemblies 115. The two stormwater management crates 100, positioned side-by-side, as depicted in FIG. 6B, are stacked on top of another layer of two side-by-side stormwater management crates 100 and are secured together through the use of column connection pins 410 (not depicted in FIG. 6B) as described herein. An additional layer of two side-by-side stormwater management crates 100 is located below the top two layers of stormwater management crates 100 and includes similar connections at column connection recesses 145. In this way, stormwater management crate array 600, as depicted in FIG. 6B, is made of twelve plates 105, each pair of intermediate plates 615 with six support column assemblies 115. Though FIG. 6B depicts an array formed from six stormwater management crates, one skilled in the art will appreciate that the array of stormwater management crates 600 may be composed of any number of configurations of stormwater management crates 100 to suit the site conditions and requirements. For example, more or fewer plates, column assemblies, or base plates can be used. In addition, the number of column assemblies in a particular stormwater management crate 100 can vary within a single stormwater management crate array 600.

The numbers of column assemblies 115 extending from a particular plate 105 in a stormwater management crate array 600 may depend on the position of the plate 105 within the array and the structural loading requirements associated with that position. For example, the intermediate plates 615 within the array may have six column assemblies, while the peripheral plates 105 may have seven, eight, or more column assemblies to give more structural support to the perimeter of the stormwater management crate array 600.

In another embodiment, plates 105 included in the stormwater management crate array 600 may have different gauges or thicknesses depending on their location within the stormwater management crate array 600 and the structural requirements associated with the location. For example, the plates 105 located at the top of the stormwater management crate array 600 may be sized to support structural requirements for surface loads placed above the stormwater management crate array 600, vehicular loads, and walking loads. For example, stormwater management crate array 600 may be buried underneath fill material, and a site improvement such as a parking lot may be constructed above the fill material. In this example, the plates 105 located at the top of the stormwater management crate array 600 may be sized to support the loading requirements of the fill material, parking lot, and live loads associated with vehicular traffic. These structural loads may be transmitted to the plates 105 located at the bottom of the stormwater management crate array 600 through support column assemblies 115. Plates 105 located at the bottom of the stormwater management crate array 600 may be sized to transmit the total weight of these loads and the weight of the stormwater management crate array 600 to the surface below stormwater management crate array 600, and also to support the soil and water pressures located below the ground surface. Intermediate plates 615 located in between the top and bottom plates do not carry the same loads, and may be sized to support a walking load only, and therefore may be formed of lighter gauge material. In some embodiments, a top plate may have a certain weight, and a bottom plate may have a certain plate. The weight of the top or bottom plate may be influenced by the total weight of the loads these plates transmit, as discussed herein. As a result, in some embodiments, the weight of the plates 105 located at the top of the stormwater management crate array 600 may be identical to the weight of the plates 105 located at the bottom of the stormwater management crate array 600. In some embodiments, the weight of the top plate may be substantially the same as the weight of the bottom plate. As discussed herein, substantially the same as may describe different components having a weight, including but not limited to plates of a stormwater management crate, with the weight of the components within manufacturing tolerances of one another. In some embodiments, the weight of the plates 105 located at the top of the stormwater management crate array 600 may be different than the weight of the plates 105 located at the bottom of the stormwater management crate array 600. In an embodiment, intermediate plates 615 located in the interior of the stormwater management crate array 600 are sized to support a walking load to accommodate installation crews during assembly of the stormwater management crate array 600, permitting these intermediate plates 615 to be much lighter than the top or bottom plates 105, which reduces material costs and weight and improves efficiencies in the speed of installation of stormwater management crate array 600 because the intermediate plates 615 may be more easily handled and lifted by an installation crew.

In some embodiments, stormwater management crates may include lightweight plates. As described herein, loads on plates 105 located at the top of a stormwater management crate may be transmitted to plates 105 located at the bottom of a stormwater management crate through support column assemblies 115, as shown in FIG. 6A. In some embodiments, intermediate plates may include support column attachments. In some instances, intermediate plates 615 may not bear a vertical load when the load is transmitted through the support column assemblies 115. In some embodiments, intermediate plates 615 may bear a lesser load than plates 105 located at the top or bottom of a stormwater management crate. For example, intermediate plates 615 may be configured to bear a maximum load that is less than the load plates 105 located at the top of the stormwater management crate are configured to bear. As a result, intermediate plates 615 may be lightweight, such that they are thinner or less thick than plates 105 located at the top or bottom of a stormwater management crate. When the loads on intermediate plates 615 are low, lightweight intermediate plates may allow for easier installation without comprising the integrity of the crate assembly. In some embodiments, intermediate plates 615 may be comprised of less material than plates 105 located at the top or bottom of a stormwater management crate, and may be a different weight than plates 105 located at the top or bottom of a stormwater management crate. In some embodiments, the weight of intermediate plates 615 may be less than the weight of the top plate or the weight of the bottom plate. In some embodiments, the weight of intermediate plates 615 may be less than the weight of both the top plate and the weight of the bottom plate. Lighter weight plates may provide advantages to stormwater management crate assembly, including easier transportation of intermediate plates 615, easier handling, and simpler installation.

Figure 6C:
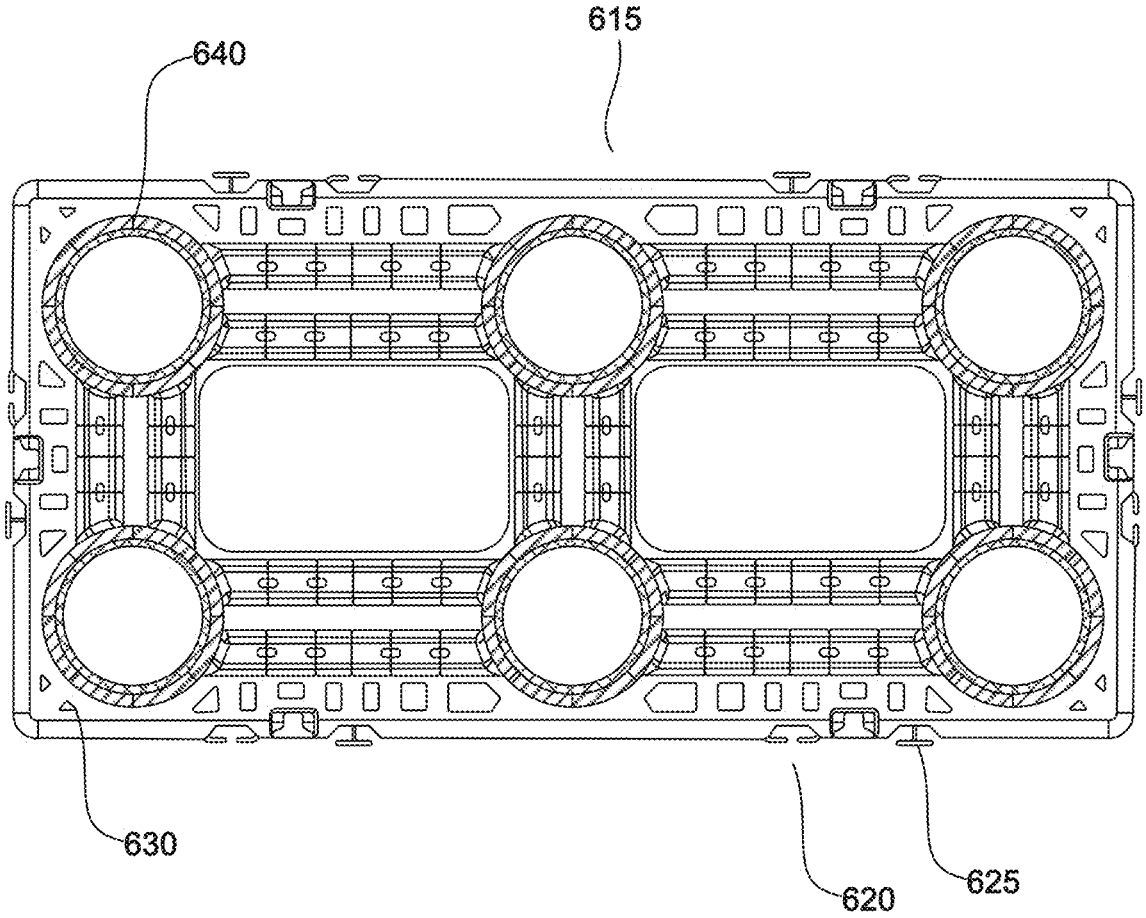
FIG. 6C depicts a top view of a lightweight intermediate plate, consistent with various embodiments of the present disclosure.

An example of a lightweight intermediate plate 615 is depicted in FIG. 6C. In some embodiments, intermediate plate 615 may include a plurality of slot locks 620 and hook locks 625. Slot locks 620 and hook locks 625 may be configured to interface with hook locks 625 and slot locks 620 of an adjacent lightweight intermediate plate 615, such that the slot lock 620 of each adjacent lightweight intermediate plate 615 may securely connect to hook lock 625 of the adjacent lightweight intermediate plate 615. In some embodiments, lightweight intermediate plate 615 may include lattice member 630. As described herein, lattice member 630 may include perforations as depicted in FIG. 6C. The perforations may be designed to reduce the weight of lightweight intermediate plate 615. Perforations may have a rectangular shape, an ovular shape, a triangular shape, a uniform shape, a nonuniform shape, a symmetrical shape, a nonsymmetrical shape, or any other suitable shape.

Figure 6D:
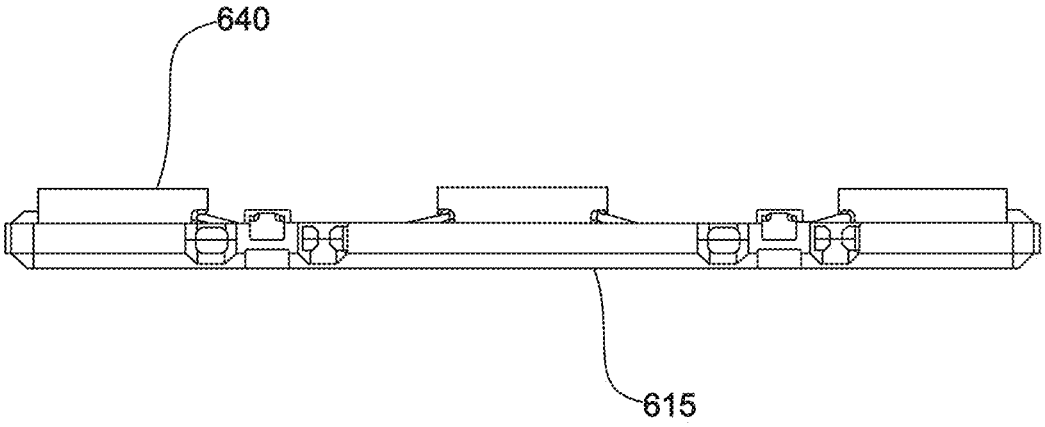
FIG. 6D depicts a side view of a lightweight intermediate plate, consistent with various embodiments of the present disclosure.

In some embodiments, lightweight intermediate plate 615 may include column connection recesses 640, as shown in FIG. 6D. Column connection recesses 640 may be configured to hold support column assemblies 115. Column connection recesses 640 may extend above or below the plane of other components of lightweight intermediate plate 615. In some embodiments, lightweight intermediate plate 615 may laterally hold support column assemblies to prevent buckling.

Figure 6E:
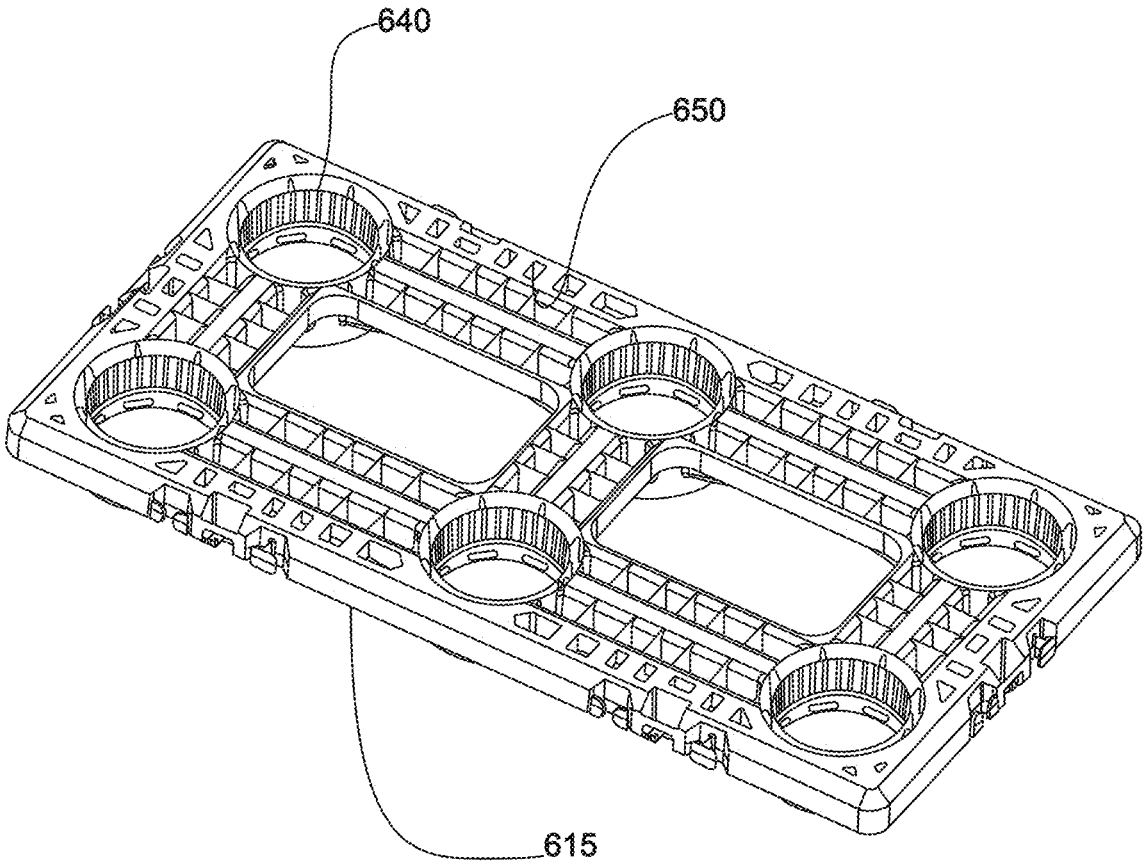
FIG. 6E depicts an isometric top view of a lightweight intermediate plate, consistent with various embodiments of the present disclosure.

In some embodiments lightweight intermediate plates 615 may include support members 650 to provide structural support and integrity, as shown in FIG. 6E. For example, support members 650 may connect the column connection recesses 640 together in lightweight intermediate plate 615. Support members 650 may be made with less plastic, thereby reducing the weight of lightweight intermediate plates 615, making lightweight intermediate plates 615 easier to handle. Lighter plates may allow for easier stormwater crate assembly and faster installation.

Figure 6F:
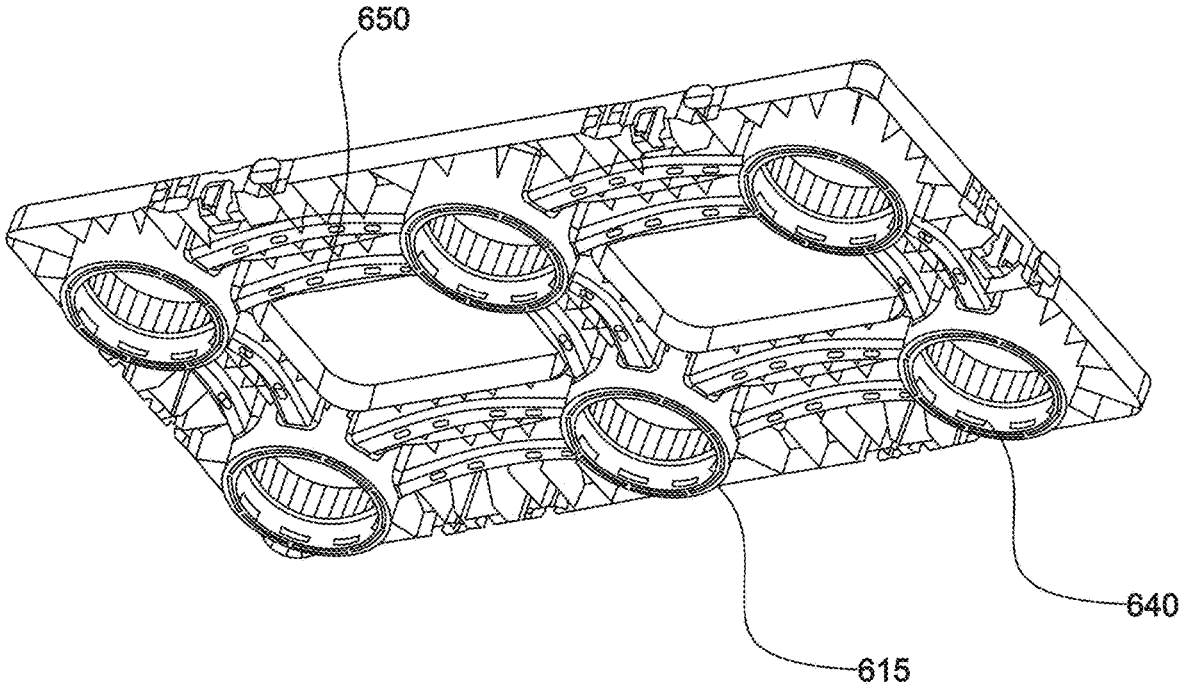
FIG. 6F depicts an isometric bottom view of a lightweight intermediate plate, consistent with various embodiments of the present disclosure.

FIG. 6F provides an underside view of an example of an embodiment of a lightweight intermediate plate 615. Lightweight intermediate plate 615 may include support members 650 connecting column connection recesses 640. As a nonlimiting example, support members 650 may include arches, trusses, and flat plastic connectors.

Figure 6G:
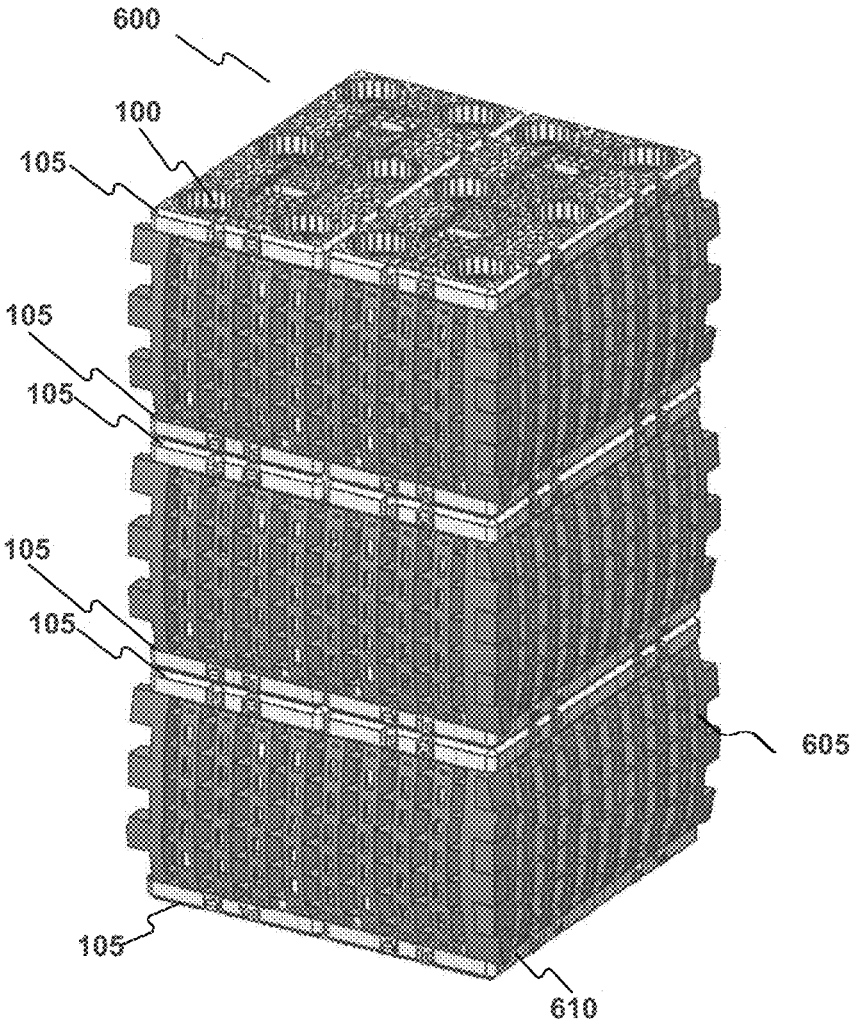
FIG. 6G depicts a stormwater management crate assembly including side panels, consistent with various embodiments of the present disclosure.

FIG. 6G. depicts an isometric view of a stormwater management crate assembly, including the side panels. In an embodiment, a stormwater management crate assembly 600 may be formed by attaching one or more side panels 605 to an array of stormwater management crates 100. Side panel 605 may have a variety of shapes, including a flat shape or a convex shape. In the embodiment depicted in FIG. 6G, side panel 605 may have, for example, a convex shape and may span the lengths of one or more stormwater management crate portions. In one embodiment, side panel 605 may have the same length as a single stormwater management crate 100 and may be equal to twice the width of a single stormwater management crate 100. For example, FIG. 6G depicts side panel 605 spanning the width of two stormwater management crates 100 and another side panel 605 spanning the length of one stormwater management crate 100. Side panel lengths are not limited to the configuration depicted in FIG. 6G and may be sized to span the length of a single stormwater management crate, four stormwater management crates, or any number of stormwater management crates depending on the site conditions.

Figure 6H:
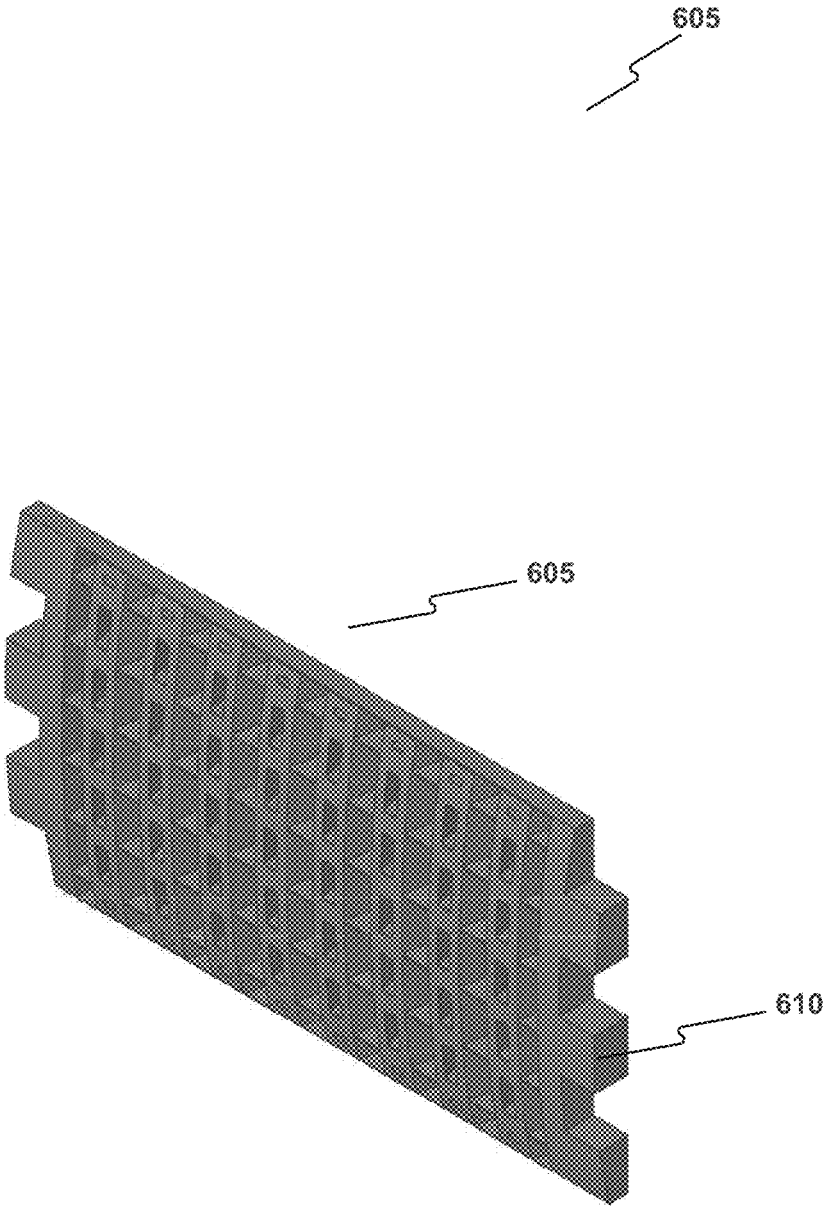
FIG. 6H depicts a side panel, consistent with various embodiments of the present disclosure.

Side panel 605 may interlock with adjacent side panels for stability and structural support. In some embodiments, side panel 605 may include side panel locks 610 as depicted in FIG. 6H. Each side panel 605 may have complementary side panel locks 610 suitable to interface with adjacent side panels for structural support and stability. Side panels 605 may be interlocked together through side panel locks 610 so that side panels 605 do not touch support column assemblies 115 or transmit structural load directly to support column assemblies 115. In one embodiment, side panels 605 are designed and sized to support lateral earthen and water pressure loads and are not designed to carry vertical loads through side panels 605. That is, vertical loads such as earthen embankments, parking lots, or the like located above stormwater management crate assembly 600 are carried by the uppermost plates 105 to support column assemblies 115 down to bottom plates 105 without transmitting the vertical loads to side panels 605. Such a design allows side panels 605 to be constructed of relatively light material which aids in speed and efficiency of manufacturing and installation costs due to a reduction in the weight of the material of the side plates. In another embodiment, side panels are configured to attach to a plate 105 and contact one or more support column assemblies 115.

Figure 7A:
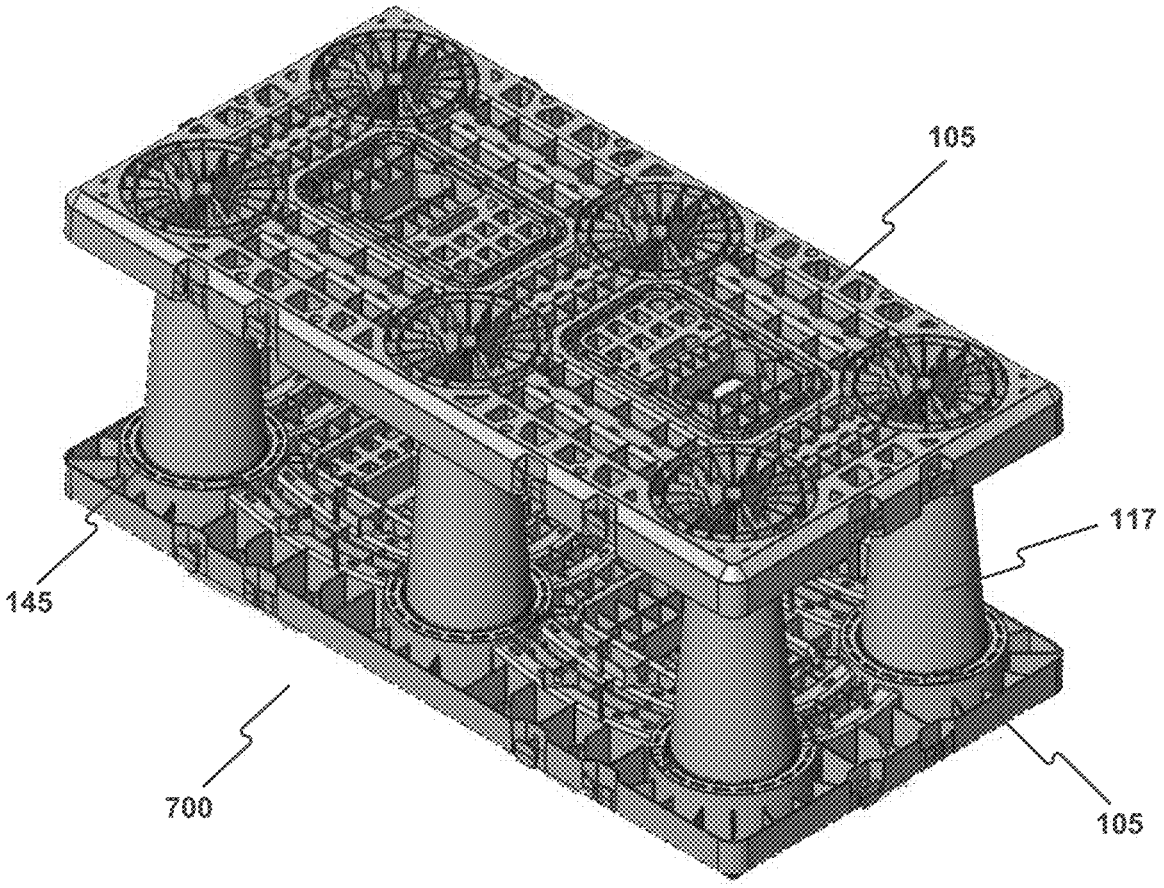
FIG. 7A depicts an isometric view of a condensed stormwater management crate, consistent with various embodiments of the present disclosure.

Side panels 605 may be manufactured in various heights. For example, site conditions such as water quantity, depth of water table, types of soil, developable land area, or other considerations may determine a design height for stormwater management crate assembly 600. Side panels 605 may vary in height to fit the design conditions. In one embodiment, side panels 605 may be manufactured with two different heights within a stormwater management crate assembly 600. For example, a side panel 605 may have a height equal to the height of a stormwater management crate 100 within the stormwater management crate assembly. The stormwater management crate assembly may include a partial stormwater management crate that includes only one set of support column portions 117, for example partial stormwater management crate 700 depicted in FIG. 7A. Partial stormwater management crate 700 may be approximately half the height of other stormwater management crates 100 within stormwater management crate assembly 600. Side panels 605 may be fabricated with a height to correspond with the height of partial stormwater management crate 700. In one embodiment, side panels 605 may be fabricated with heights of 15 inches and 30 inches. Using side panels with combinations of these two heights, various stormwater management crate assemblies 600 can be assembled in any 15 inch height increment.

In yet other embodiments, some stormwater management crates 100 within the stormwater management crate assembly 600 may not have side panels but may instead be placed against another surface, such as a retaining wall, sheet piles, an underground structure, or a different underground stormwater management system.

Figure 7B:
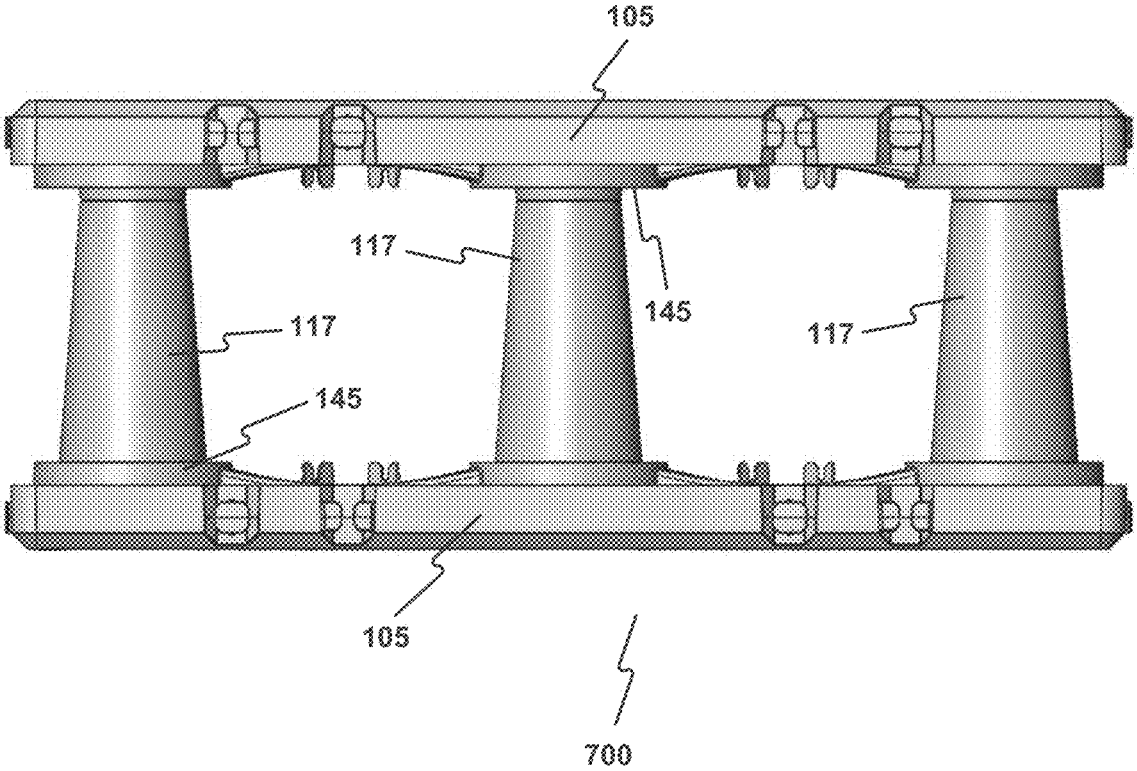
FIG. 7B depicts a side view of a condensed stormwater management crate, consistent with various embodiments of the present disclosure.

FIG. 7B depicts an embodiment of a condensed stormwater management crate 700. Condensed stormwater management crates 700 may be used in certain configurations with stormwater management crates 100 in a stormwater management crate assembly 600 to fit certain site conditions. As shown in FIG. 7B, a condensed stormwater management crate 700 may include one or more partial support column portions 117. In an embodiment, the one or more partial support column portions 117 may connect to two plates 105, one at each end of the support column portion 117 and may not be directly connected to another partial support column portion 117. This results in a condensed stormwater management crate 700 that is approximately half the height of a stormwater management crate 100. When used in a stormwater management crate assembly 600, condensed stormwater management crate 700 may be placed on the top layer of component stormwater management crates within the assembly. This allows for construction of a stormwater management crate assembly that is smaller in height and therefore capable of fitting various site conditions.

In one embodiment of a condensed stormwater management crate 700, support column portions 117 may connect to plates 105 using one or more column connection types. For example, the lower end of support column portion 117 may connect to plate 105 using a bayonet connection 205, and the top portion of support column portion 117 may connect to plate 105 using a snap connection. In another embodiment, the top end of support column portion 117 may connect to plate 105 using a bayonet connection 205, and the lower end portion of support column portion 117 may connect to plate 105 using a snap connection. In yet another embodiment, both ends of support column portion 117 may connect to each top plate 105 using a snap connection.

Stormwater management crate assembly 600 may be used to temporarily retain fluids, such as stormwater runoff, in a stormwater management system. The stormwater management system may include an inlet apparatus configured to receive runoff from a surface-level drain. The stormwater management system may also include a stormwater management crate assembly, such as stormwater management crate assembly 600. The stormwater management system may also include an inlet pipe configured to extend between, and to fluidly connect, the inlet apparatus with an inlet end of the stormwater management crate assembly. The stormwater management system may also include a filtration fabric configured to be situated beneath at least a portion of the bottom of the stormwater management crate assembly. The filtration fabric may be configured to capture sediment from the runoff in the stormwater management crate assembly while the runoff flows out of the stormwater management crate assembly. The stormwater management system may also include a non-woven geotextile fabric, bituminous covering, synthetic polymer plastic sheeting, or other suitable geotextile fabrics configured to cover the exterior surface of the side panels of the stormwater management crate assembly. The stormwater management crate assembly may be fluidly connected with the inlet apparatus and may be configured to receive the runoff from the inlet apparatus and to disperse runoff into at least one of the earth or an outlet, such as an underground drainage structure. In some embodiments, stormwater management crate assembly 600 may be configured to leach stormwater to the surrounding soil through a water pervious geotextile sheeting. In other embodiments, stormwater management crate assembly 600 may be wrapped in a water impermeable sheeting and may then retain stormwater until it is pumped out of the assembly or passed through a restrictive flow control in an outlet.

Stormwater management crates may be fabricated using certain molding techniques. In an embodiment, insert molding techniques are used to secure plates and column components together. Insert molding may refer to a method of forming plastic components (e.g., polypropylene, HDPE, LDPE, PVC, polyethylene, polyurethane) with at least two separate shots of molding where one component is then incorporated into another component. For example, in an embodiment, a plate component may be fabricated and then a column assembly component may be formed separately in a recess of the plate component. In another embodiment, the column assemblies may be formed first and the plate component may be molded around the column assemblies. Both plates and column assemblies may be made in the same molding press, for example where the molding tool rotates, or where parts are transferred from one side of the tool to the other. In another embodiment, two separate molding presses may be used, for example, in which molded parts from a first press are transferred to a second press for insert molding. Such techniques may provide various solutions or improvements over existing art. For example, though molding plates and column components together may not allow for rotation of columns in the column connection sockets as described above, an insert molding approach will yield a secure attachment between plates and columns which may provide better resistance to racking actions in a stormwater crate assembly and may also provide improved impact resistance after assembly.

Stormwater management crates that use insert molding techniques to secure plates and column components may advantageously use dissimilar materials between crate components to take advantage of beneficial effects. For example, in an embodiment involving insert molding, stormwater crate columns may be formed of glass-filled polypropylene to take advantage of its superior strength and ability to resist compressive forces whereas the plate components may be formed of virgin polypropylene to take advantage of its superior flexibility. As described above, the majority of compressive forces in the stormwater crate assembly may pass through the columns and not to the plate components, so the plate components may not require the additional strength of glass-filled reinforcement.

After injection, injectable plastics may shrink as the material cools after being injected into a mold. The amount of shrinkage may depend on the type of materials used, the size of the mold, the quantity of materials used, or other factors. Variable shrink rates between different materials may be considered to secure component pieces together. For example, virgin polypropylene may have a shrink rate as high as 0.021 inch/inch, while a twenty percent glass-filled polypropylene mixture might have a shrink rate around 0.004 inch/inch. In an embodiment, plates may first be formed of virgin polypropylene and column assemblies formed of glass-filled polypropylene may be formed second in a recess of the first-formed plate. The plate may then shrink onto the column assembly to secure the column assembly into the plate because the higher shrink rate of the plate compared to the shrink rate of the column assembly results in the plate shrinking around the column assembly, thereby locking the column assembly into the plate. Plates and column assemblies are not limited to the combination of virgin polypropylene and glass-filled polypropylene and may include other materials such as polypropylene, HDPE, LDPE, PVC, polyethylene, or polyurethane. Though in some embodiments the plate components and the column assembly components are secured through the variable shrinkage between components, in other embodiments undercut features may be incorporated to secure plate and column assembly components together. An undercut feature may include a structural component imbedded into the plate or column (or both) that restrains the components together. Undercut features may be included in embodiments that employ dissimilar materials between components and may be used to secure components together in combination with the variable shrinkage rates. In other embodiments, undercut features are employed to secure column assembly and plate components together when the column and plate components are formed from common materials, and thus, do not have variable shrinkage rates. Various embodiments of certain undercut features are further described in reference to FIGS. 8-14.

Figure 8:
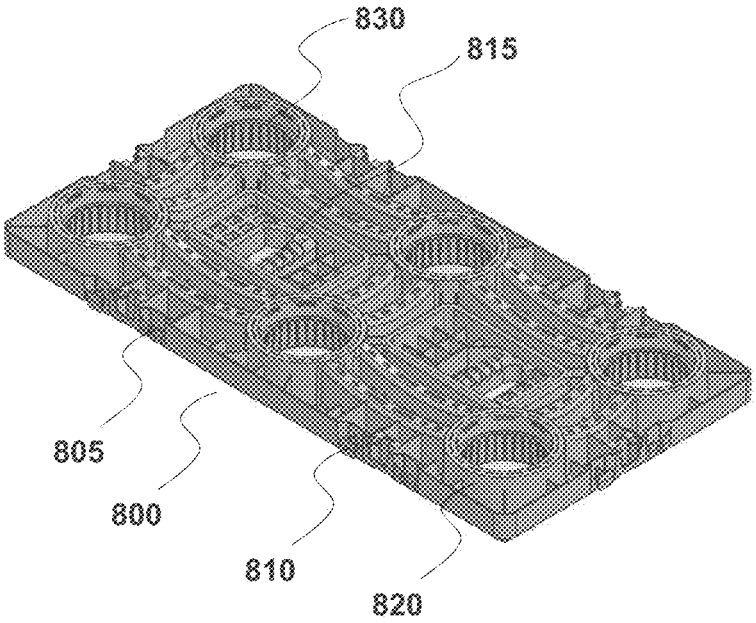
FIG. 8 depicts an isometric view of another embodiment of a top plate flipped upside down, consistent with various embodiments of the present disclosure.

FIG. 8 depicts an isometric view of another embodiment of a top plate flipped upside down, consistent with various embodiments of the present disclosure. Though described as a top plate flipped upside down, in some embodiments bottom plates are flipped versions of top plates, so the description of top plates flipped upside down may equally apply to bottom plates. In an embodiment, plate 800 may include one or more slot locks 805 and hook locks 810. Slot locks 805 and hook locks 810 may correspond to slot locks 120 and hook locks 125 described herein. Slot locks 805 and hook locks 810 may be configured to interface with an adjacent plate 800 in a stormwater crate assembly. Plate 800 may include hand grip 815. Hand grip 815 may correspond to hand grip 135 described herein. Hand grip 815 may be formed to allow a single person to grip and lift plate 800. Plate 800 may include a plurality of support column attachments 820. For example, in an embodiment, plate 800 may include six support column attachments 820 as depicted in FIG. 8, though alternative embodiments with two, four, or eight support column attachments may be used. As shown in FIG. 8, support column attachments 820 may be a circular ring circumscribing an aperture in the horizontal plane of the top plate. Column rest 830 may be located in a recessed position concentrically within the circular ring of the support column attachment 820.

Figure 9:
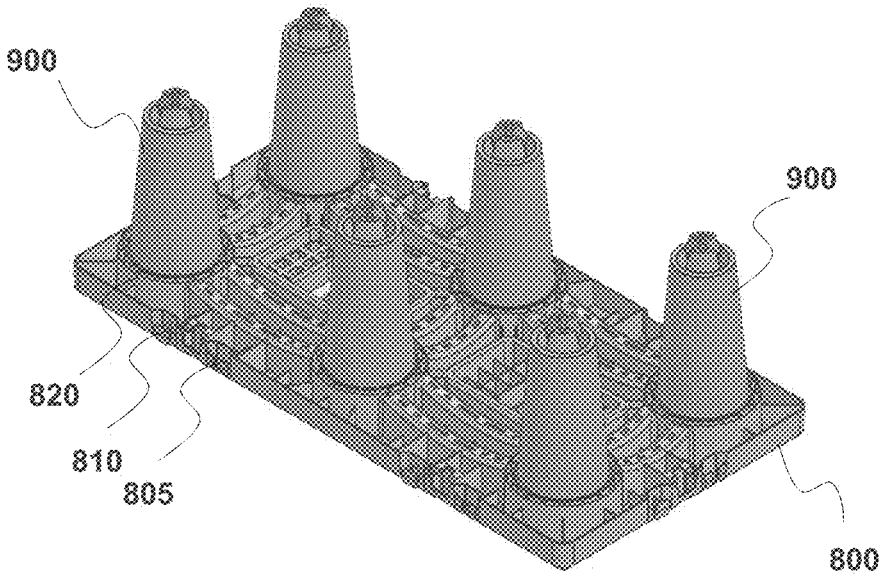
FIG. 9 depicts an isometric view of another embodiment of a plate with support column assemblies molded to the plate consistent with various embodiments of the present disclosure.

FIG. 9 depicts an isometric view of another embodiment of a plate with support column assemblies molded to the plate consistent with various embodiments of the present disclosure. As shown in FIG. 9, a plurality of support column assemblies 900 may be molded to the plate 800 at support column attachment 820. Support column assemblies 900 may be tapered in shape, with a wider end at the support column attachment 820 and a narrower end extending away from the plate 800. Similar to FIG. 1A, two plates 800 with support column assemblies 900 may be stacked vertically and may be connected at the narrow ends of the tapered support column assemblies through the use of snap connections.

Figure 10:
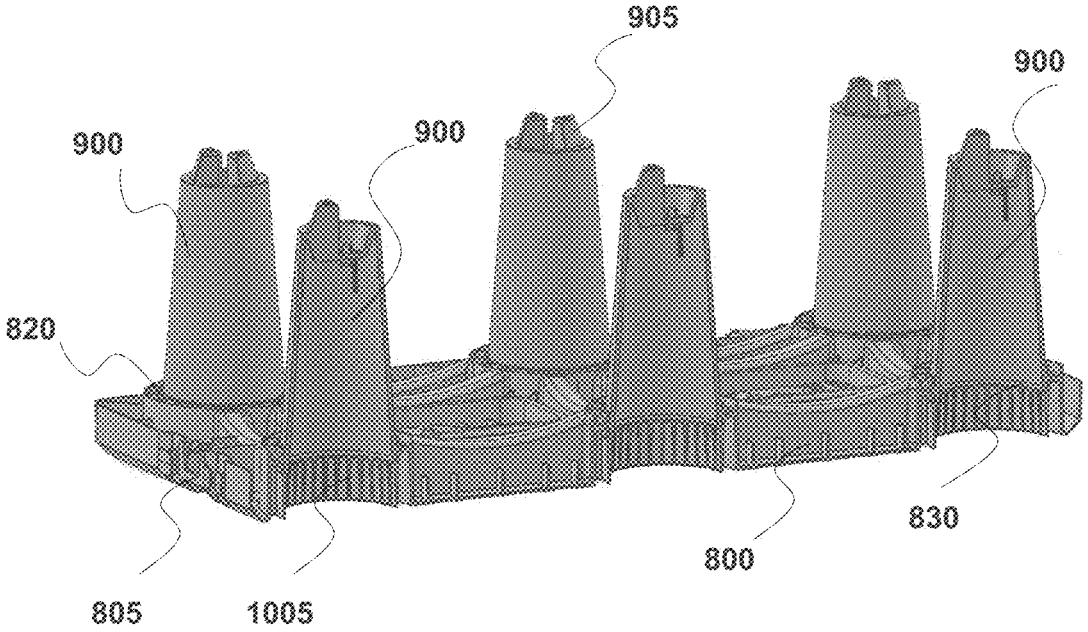
FIG. 10 depicts an isometric section view of another embodiment of a plate with support column assemblies molded to the plate, with the section view cut through the plate and columns exposing an interior view of the support column assemblies and support column attachments consistent with various embodiments of the present disclosure.

FIG. 10 depicts an isometric section view of another embodiment of a plate with support column assemblies molded to the plate, with the section view cut through the plate and columns exposing an interior view of the support column assemblies and support column attachments consistent with various embodiments of the present disclosure. For example, FIG. 10 shows an interior cutaway view of a support column assembly 900. As is shown in FIG. 10, support column assemblies 900 abut column rest 830. Support column attachments 820 may also include a plurality of stiffening ribs 1005. Stiffening ribs 1005 may provide structural support and increase rigidity of support column attachments 820.

Figure 11:
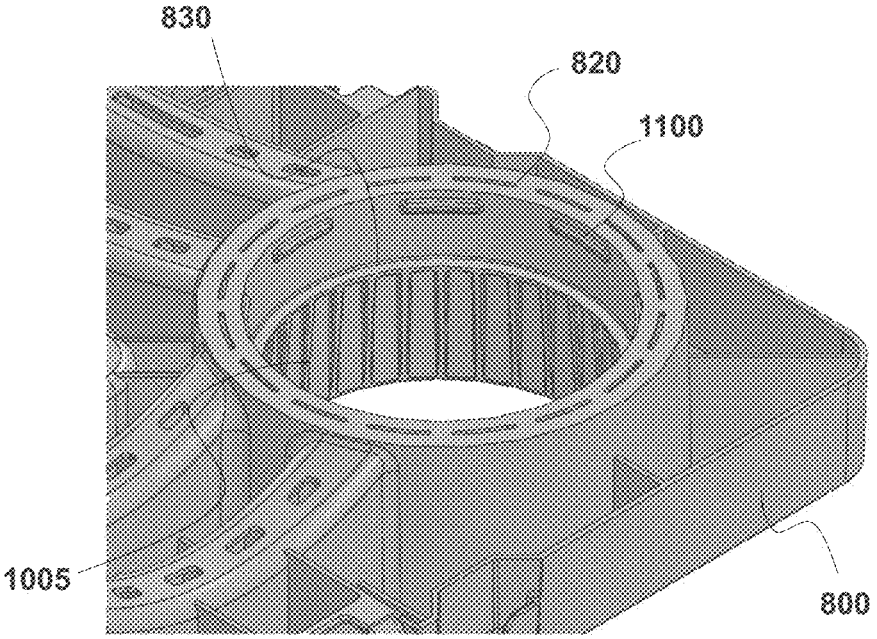
FIG. 11 depicts an isometric view of an embodiment of a support column attachment consistent with various embodiments of the present disclosure.

FIG. 11 depicts an isometric view of an embodiment of a column connection attachment consistent with various embodiments of the present disclosure. As shown in FIG. 11, support column attachments 820 may have a circular ring, though other shapes such as squares or triangular shapes may be used in alternative embodiments. Column rest 830 may be located in a recessed position concentrically within the circular ring of the support column attachment 820. Column rest 830 may also demark a separation between stiffening ribs 1005 and the portion of the support column attachment 820 that receives the support column assembly 900. FIG. 11 depicts a plurality of tab prongs 1100 located between the circular ring and the recessed circular column rest 830. The tab prongs 1100 may act as an undercut feature as described above. For example, support column assemblies 900 may be formed with a reciprocal divot that encases tap prongs 1100, locking the support column assembly 900 to the tab prong 1100 thereby securing support column assembly 900 to the support column attachment 820 and the plate 800.

Figure 12:
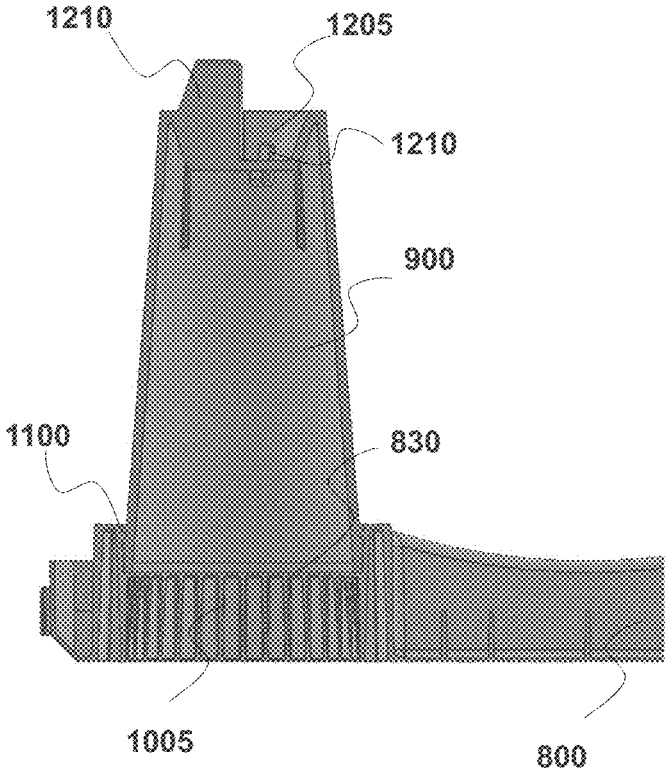
FIG. 12 depicts an interior section view of a plate and support column assembly molded to a plate when viewed upside down consistent with various embodiments of the present disclosure.

FIG. 12 depicts an interior section view of a plate and support column assembly molded to a plate when viewed upside down consistent with various embodiments of the present disclosure. As is shown in FIG. 12, support column assembly 900 may abut column rest 830 and may further encase tab prong 1100. The cutaway image of FIG. 12 also depicts a cutaway of the snap connections used to connect column assemblies 900 when stacked vertically to another column assembly 900. Column assembly 900 may include snap connector 1210 inside of a recess 1205. Protrusion 1210 may include an orifice in the top (not shown in FIG. 12) to receive a reciprocal snap connector 1210 from another column assembly 900. The snap style connection of column assembly 900 may correspond to the snap connection hooks 305 snap connection slots 310 described above and depicted in FIG. 3A.

Figure 13:
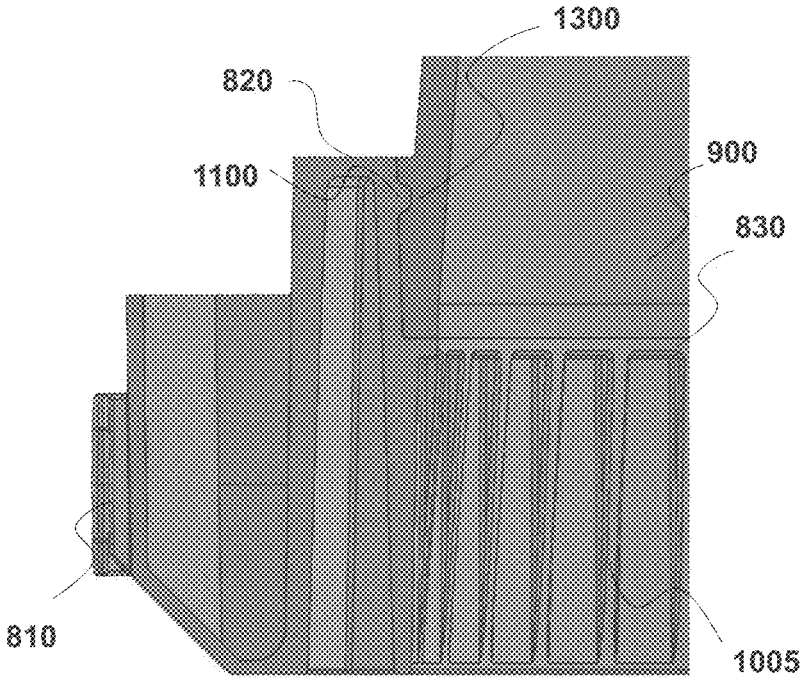
FIG. 13 depicts an interior section view of an embodiment of a column connection assembly molded to a support column attachment consistent with various embodiments of the present disclosure.

FIG. 13 depicts an interior section view of an embodiment of a column connection assembly molded to a support column attachment consistent with various embodiments of the present disclosure. As is shown in FIG. 13, column 900 may include a one or more divots or tab slots 1300 that correspond to tab prong 1100 in the support column attachment 820. In an embodiment, plate 800 is formed in a first molding and support column assembly 900 is formed in a second insert molding injection so that support column assembly 900 is formed inside the support column attachment 820 and divot 1300 is formed encloses tab 1100. This connection may secure the support column assembly 900 to the plate. In another embodiment, the support column assemblies 900 are formed first, and the plate 800 is formed around the support column assemblies 900 so that tabs 1100 are inserted into the divots 1300.

Figure 14:
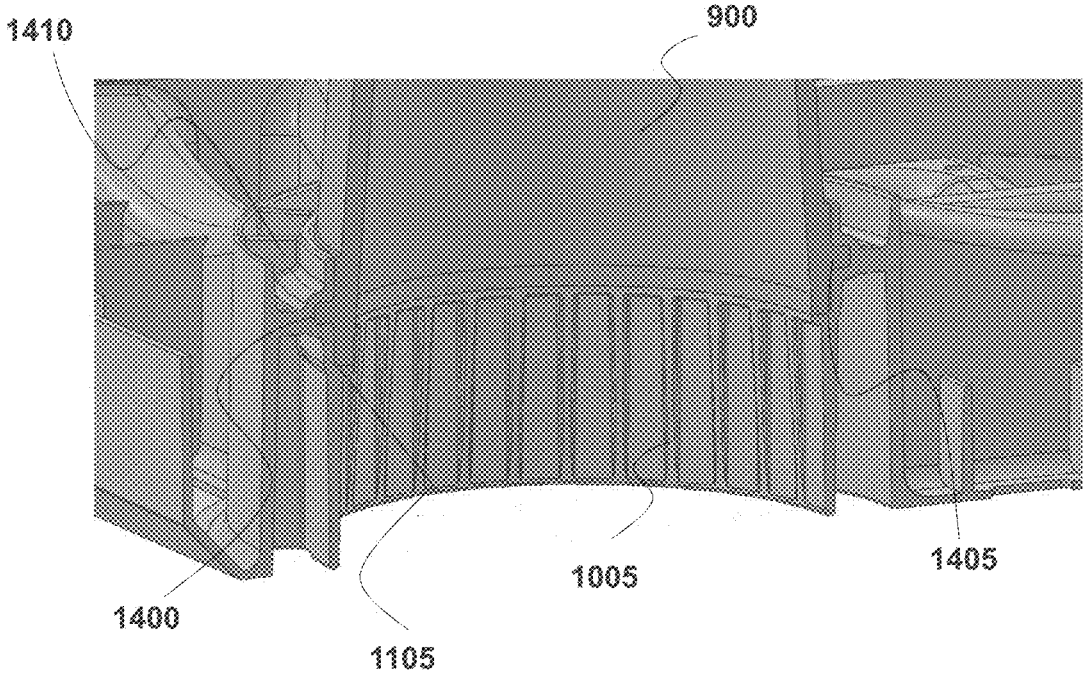
FIG. 14 depicts an interior section view of another embodiment of a support column assembly molded to a support column attachment consistent with various embodiments of the present disclosure.

FIG. 14 depicts an interior section view of another embodiment of a support column assembly molded to a support column attachment consistent with various embodiments of the present disclosure. As shown in FIG. 14, column 900 may have one or more protruding tab prongs 1405 around the base of the column. Protruding tab prongs 1405 may correspond to one or more tab slot 1400 in a column connection assembly. Support column assembly 900 may be formed so that one or more protruding tab prong 1405 locks support column assembly 900 by fitting inside the tab slot 1400 in the column connection assembly. A support column attachment may further have support ribs 1410 around the outside of the base of the support column assembly 900.

The foregoing description has been presented for purposes of illustration. It is not exhaustive and is not limited to precise forms or embodiments disclosed. Modifications and adaptations of the embodiments will be apparent from consideration of the specification and practice of the disclosed embodiments. For example, while certain components have been described as being coupled to one another, such components may be integrated with one another or distributed in any suitable fashion.

Moreover, while illustrative embodiments have been described herein, the scope includes any and all embodiments having equivalent elements, modifications, omissions, combinations (e.g., of aspects across various embodiments), adaptations and/or alterations based on the present disclosure. The elements in the claims are to be interpreted broadly based on the language employed in the claims and not limited to examples described in the present specification or during the prosecution of the application, which examples are to be construed as nonexclusive. Further, the steps of the disclosed methods can be modified in any manner, including reordering steps and/or inserting or deleting steps.

The features and advantages of the disclosure are apparent from the detailed specification, and thus, it is intended that the appended claims cover all systems and methods falling within the true spirit and scope of the disclosure. As used herein, the indefinite articles "a" and "an" mean "one or more." Similarly, the use of a plural term does not necessarily denote a plurality unless it is unambiguous in the given context. Words such as "and" or "or" mean "and/or" unless specifically directed otherwise. Further, since numerous modifications and variations will readily occur from studying the present disclosure, it is not desired to limit the disclosure to the exact construction and operation illustrated and described, and, accordingly, all suitable modifications and equivalents may be resorted to, falling within the scope of the disclosure.

Other embodiments will be apparent from consideration of the specification and practice of the embodiments disclosed herein. It is intended that the specification and examples be considered as example only, with a true scope and spirit of the disclosed embodiments being indicated by the following claims.

What is claimed is:

1. A stormwater management crate for managing stormwater runoff, the crate comprising:

a top plate;

a plurality of support column assemblies affixed to the top plate;

a bottom plate located below the plurality of support column assemblies;

at least one intermediate plate, the at least one intermediate plate located below the top plate and above the bottom plate, wherein the at least one intermediate plate comprises one or more stabilization pin on a top surface of the at least one intermediate plate configured to connect to one or more recess in a bottom surface of a second intermediate plate; and one or more convex side panels configured to attach to one or more sides of the stormwater management crate without contacting the support column assemblies.

2. The stormwater management crate of claim 1, wherein the support column assemblies are affixed to the at least one intermediate plate.

3. The stormwater management crate of claim 2, wherein the top plate is configured to bear a load greater than a maximum load the intermediate plate is configured to bear.

4. The stormwater management crate of claim 1, wherein the intermediate plate has a weight, the top plate has a weight, and the bottom plate has a weight, the weight of the intermediate plate being less than the weight of one or both of the top plate and the weight of the bottom plate.

5. The stormwater management crate of claim 4, wherein the weight of the top plate is substantially the same as or identical to the weight of the bottom plate.

6. The stormwater management crate of claim 1, wherein the support column assemblies have a tapered shape.

7. The stormwater management crate of claim 1, wherein the top plate, bottom plate, and at least one intermediate plate are each distinct from one another.

8. A stormwater management crate for managing stormwater runoff, the crate comprising:

a top plate;

a plurality of support column assemblies affixed to the top plate; and a lightweight plate located below the plurality of support column assemblies, wherein the lightweight plate comprises one or more stabilization pin on a top surface of the lightweight plate configured to connect to one or more recess in a bottom surface of a second lightweight plate; and one or more convex side panels configured to attach to one or more sides of the stormwater management crate without contacting the support column assemblies;

wherein the lightweight plate weighs less than the top plate.

9. The stormwater management crate of claim 8, wherein the support column assemblies have a tapered shape.

10. The stormwater management crate of claim 8, wherein the lightweight plate comprises less material than the top plate.

11. The stormwater management crate of claim 8, wherein the lightweight plate includes hook locks and slot locks.

12. The stormwater management crate of claim 11, wherein the lightweight plate is affixed to an adjacent lightweight plate.

13. The stormwater management crate of claim 8, wherein the lightweight plate includes perforations.

14. The stormwater management crate of claim 8, wherein the lightweight plate includes support members.

15. The stormwater management crate of claim 8, wherein lightweight plate includes column connection recesses.

16. A stormwater management crate assembly for managing stormwater runoff comprising:

a plurality of stormwater management crates arranged in a modular array, the stormwater management crates comprising:

a top plate;

a plurality of support column assemblies affixed to the top plate;

a bottom plate located below the plurality of support column assemblies; and at least one intermediate plate, the at least one intermediate plate located below the top plate and above the bottom plate, wherein the at least one intermediate plate comprises one or more stabilization pin on a top surface of the at least one intermediate plate configured to connect to one or more recess in a bottom surface of a second intermediate plate; and one or more convex side panels configured to attach to one or more sides of the stormwater management crate without contacting the support column assemblies.

17. The stormwater management crate assembly of claim 16, wherein the at least one intermediate plate weighs less than the one or both of top plate and the bottom plate.

18. The stormwater management crate assembly of claim 16, wherein a first stormwater management crate is stacked vertically on top of a second stormwater management crate.

19. The stormwater management crate assembly of claim 16, wherein each of the first plurality of support column assemblies and the second plurality of support column assemblies has a tapered shape.

* * * * *